US009289985B2

(12) United States Patent
Akahane

(10) Patent No.: US 9,289,985 B2
(45) Date of Patent: Mar. 22, 2016

(54) LIQUID EJECTING HEAD UNIT AND LIQUID EJECTING APPARATUS

(71) Applicant: Seiko Epson Corporation, Shinjuku-ku (JP)

(72) Inventor: Fujio Akahane, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/599,294

(22) Filed: Jan. 16, 2015

(65) Prior Publication Data

US 2015/0202866 A1 Jul. 23, 2015

(30) Foreign Application Priority Data

Jan. 22, 2014 (JP) ..... 2014-009868

(51) Int. Cl.
*B41J 2/135* (2006.01)
*B41J 2/14* (2006.01)

(52) U.S. Cl.
CPC ..... *B41J 2/14* (2013.01); *B41J 2202/19* (2013.01); *B41J 2202/20* (2013.01)

(58) Field of Classification Search
CPC ..... B41J 2/1631; B41J 2/1628; B41J 2/1642; B41J 2/1623; B41J 2/1639
USPC ..... 347/44, 20, 54, 66, 84–87, 8
See application file for complete search history.

(56) References Cited

U.S. PATENT DOCUMENTS 7,942,497 B1 * 5/2011 Matsumoto et al. ..... 347/42
9,132,660 B2 * 9/2015 Ngo ..... B41J 2/155

FOREIGN PATENT DOCUMENTS

JP 2-167749 6/1990
JP 09-148768 A 6/1997
JP 2006-256049 * 9/2006 ..... B41J 2/16
JP 2006-256049 A 9/2006

* cited by examiner

*Primary Examiner* — Manish S Shah
*Assistant Examiner* — Yaovi Ameh
(74) *Attorney, Agent, or Firm* — Kilpatrick Townsend & Stockton LLP

(57) ABSTRACT

A liquid ejecting head unit includes: a liquid ejecting head having a liquid ejecting surface in which a nozzle opening for ejecting liquid is formed; a head fixing substrate which holds the surface sides opposite to the liquid ejecting surfaces of a plurality of liquid ejecting heads; and a height changing-fixing section which is provided between the head fixing substrate and the liquid ejecting head and can adjust a distance between the head fixing substrate and the liquid ejecting head, in which the height changing-fixing section is detachably fixed to the surface opposite to the liquid ejecting surface of the liquid ejecting head, and the height changing-fixing section and the head fixing substrate are detachably fixed to each other by screwing from the surface side opposite to a fixing surface of the head fixing substrate, to which the liquid ejecting head is fixed through the height changing-fixing section.

18 Claims, 9 Drawing Sheets

LIQUID EJECTING HEAD UNIT AND LIQUID EJECTING APPARATUS

CROSS REFERENCES TO RELATED APPLICATIONS

This application claims priority to Japanese Patent Application No. 2014-009868 filed on Jan. 22, 2014. The entire disclosure of Japanese Patent Application No. 2014-009868 is hereby incorporated herein by reference.

BACKGROUND

1. Technical Field

The present invention relates to a liquid ejecting head unit which is provided with a plurality of liquid ejecting heads which eject liquid, and a liquid ejecting apparatus which is provided with the liquid ejecting head unit, and in particular, to an ink jet type recording head unit which ejects ink as liquid and an ink jet type recording apparatus.

2. Related Art

As an ink jet type recording head unit which is an example of a liquid ejecting head unit, an ink jet type recording head unit is proposed which is provided with an ink jet type recording head which ejects ink droplets from nozzle openings by a pressure change of pressure generating means, and a head fixing substrate to which a plurality of ink jet type recording heads are bonded on the side opposite to a liquid ejecting surface with the nozzle openings formed therein (refer to, for example, JP-A-2006-256049).

In such an ink jet type recording head unit, by forming a long nozzle row by the plurality of ink jet type recording heads, it is possible to improve yield and reduce the cost, compared to a case of forming a long nozzle row in a single ink jet type recording head.

However, in a case where an ink jet type recording head unit having an elongated shape is configured by bonding a plurality of ink jet type recording heads to a head fixing substrate, since an adhesive is used, there is a problem in that replacement of the ink jet type recording head is difficult. In particular, in a case where a plurality of ink jet type recording heads are arranged side by side, the entire ink jet type recording head unit has to be replaced even when only one ink jet type recording head has failed, and thus there is a problem in that the cost becomes higher.

Further, in a case where an ink jet type recording head is bonded to a head fixing substrate by an adhesive, the amount of protrusion of the adhesive has to be controlled, and thus there is a problem in that it is difficult to control the amount of protrusion of the adhesive with a high degree of accuracy.

In addition, such problems are likewise present in not only the ink jet type recording head unit, but also in a liquid ejecting head unit which ejects liquid other than ink.

SUMMARY

An advantage of some aspects of the invention is that it provides a liquid ejecting head unit in which it is possible to facilitate mounting and dismounting of a liquid ejecting head and the heights of liquid ejecting surfaces of a plurality of liquid ejecting heads can be easily adjusted, and a liquid ejecting apparatus.

Aspect 1

According to this aspect of the invention, there is provided a liquid ejecting head unit including: a liquid ejecting head having a liquid ejecting surface in which a nozzle opening for ejecting liquid is formed; a head fixing substrate which holds the surface sides opposite to the liquid ejecting surfaces of a plurality of liquid ejecting heads; and a height changing-fixing section which is provided between the head fixing substrate and the liquid ejecting head and can adjust a distance between the head fixing substrate and the liquid ejecting head, wherein the height changing-fixing section is detachably fixed to the surface opposite to the liquid ejecting surface of the liquid ejecting head, and the height changing-fixing section and the head fixing substrate are detachably fixed to each other by screwing from the surface side opposite to a fixing surface of the head fixing substrate, to which the liquid ejecting head is fixed through the height changing-fixing section.

In such an aspect, the liquid ejecting head is fixed to the head fixing substrate by using the height changing-fixing section capable of being mounted on and dismounted from the head fixing substrate, whereby it becomes possible to easily replace only one liquid ejecting head among the plurality of liquid ejecting heads. Further, height adjustment of the liquid ejecting surfaces of the plurality of liquid ejecting heads is performed by the height changing-fixing section, whereby, compared to a case of performing height adjustment according to the thickness of an adhesive by using the adhesive, it is possible to perform the adjustment with a high degree of accuracy and the control of the thickness of an adhesive is not required, and thus it is possible to prevent trouble due to protrusion of an adhesive.

Aspect 2

Here, in Aspect 1, it is preferable that the plurality of liquid ejecting heads be arranged side by side on the head fixing substrate, and when viewed from a direction orthogonal to the liquid ejecting surface, an outline which becomes a boundary on the liquid ejecting surface side between the liquid ejecting heads adjacent to each other in an arrangement direction of the liquid ejecting heads be provided to be inclined with respect to a relative movement direction of a recording medium. According to this, it becomes possible to dispose the nozzle openings of the liquid ejecting heads adjacent to each other in the arrangement direction at the same position in the relative movement direction of the recording medium. In this way, it becomes possible to continuously dispose dots formed by landing liquid ejected from the respective nozzle openings of the liquid ejecting heads arranged in the arrangement direction on the recording medium, at regular intervals in the arrangement direction. Further, by controlling the ejection of the nozzle openings disposed at the same position in the relative movement direction, it becomes possible to reduce deterioration of printing quality of the joint of dots between the liquid ejecting heads adjacent to each other in the arrangement direction. Therefore, it is possible to form a nozzle row which is long in the arrangement direction.

Aspect 3

Further, in Aspects 1 and 2, it is preferable that the plurality of liquid ejecting heads be arranged side by side on the head fixing substrate, and when viewed from a direction orthogonal to the liquid ejecting surface, the height changing-fixing section for each liquid ejecting head be disposed at a position which falls within an outline of the liquid ejecting head in an arrangement direction of the liquid ejecting heads. According to this, it becomes possible to continuously dispose dots formed by landing liquid ejected from the respective nozzle openings of the liquid ejecting heads arranged in the arrangement direction on the recording medium, at regular intervals in the arrangement direction. Further, by controlling the ejection of the nozzle openings disposed at the same position in the relative movement direction, it becomes possible to reduce deterioration of printing quality of the joint of dots between the liquid ejecting heads adjacent to each other in the arrangement direction. Therefore, it is possible to form a nozzle row which is long in the arrangement direction.

Aspect 4

Further, in Aspects 1 to 3, it is preferable that a plurality of liquid ejecting heads be arranged side by side on the head fixing substrate, and when viewed from a direction orthogonal to the liquid ejecting surface, at least a portion of the height changing-fixing section for each liquid ejecting head be provided further to the outside than an outline on the liquid ejecting surface side of the liquid ejecting head in a relative movement direction of a recording medium. According to this, since it is possible to fix the liquid ejecting head by the height changing-fixing section disposed at positions away from each other, fine adjustment of the height, the inclination, or the like of the liquid ejecting surface of the liquid ejecting head can be easily performed.

Aspect 5

Further, in Aspects 1 to 4, it is preferable that at least three of the height changing-fixing section be provided for each liquid ejecting head. According to this, by providing at least three height changing-fixing sections, it is possible to adjust the inclination of the liquid ejecting surface of the liquid ejecting head.

Aspect 6

Further, in Aspects 1 to 5, it is preferable that a contact surface between the height changing-fixing section and the liquid ejecting head be located further to the liquid ejecting surface side than an end portion on the head fixing substrate side of the liquid ejecting head in a direction orthogonal to the liquid ejecting surface. According to this, it is possible to suppress an increase in the size of the liquid ejecting head unit in a direction orthogonal to the liquid ejecting surface due to providing the height changing-fixing section.

Aspect 7

Further, in Aspects 1 to 6, it is preferable that the height changing-fixing section and the liquid ejecting head be detachably fixed to each other by screwing from the surface side opposite to the liquid ejecting head, of the height changing-fixing section. According to this, the replacement of the height changing-fixing section becomes easier due to the screwing, and it is possible to easily perform the adjustment of the height or the inclination of the liquid ejecting surface. Further, it is possible to suppress sticking of liquid to a screw and prevent stuck liquid from falling to the recording medium at an unexpected timing. Further, since screwing directions are the same between the head fixing substrate and the height changing-fixing section and between the height changing-fixing section and the liquid ejecting head, workability is good.

Aspect 8

Further, in Aspects 1 to 7, it is preferable that the liquid ejecting head be provided with first and second members with flow paths provided therein, the height changing-fixing section be fixed to the first member, the first member and the second member be detachably fixed to each other, and a filter crossing the flow path be provided in the first member. According to this, it is possible to detach the filter from the liquid ejecting head. Therefore, even if foreign matter enters the flow path of the second member which is further on the downstream side of the flow path than the filter in a manufacturing step or the like, it is possible to easily perform the cleaning of the liquid ejecting head by causing liquid in the flow path to flow back, or the like.

Aspect 9

Further, in Aspect 8, it is preferable that the first member and the second member be fastened to each other by screwing from the surface side opposite to the second member, of the first member. According to this, mounting and dismounting of the first member and the second member can be easily performed and it is possible to suppress sticking of liquid to a screw and prevent stuck liquid from falling to the recording medium at an unexpected timing. Further, since screwing directions are the same between the head fixing substrate and the height changing-fixing section and between the first member and the second member, workability is good.

Aspect 10

In addition, according to this aspect of the invention, there is provided a liquid ejecting apparatus including: the liquid ejecting head unit according to any one of Aspects 1 to 9 described above.

In such an aspect, it is possible to realize a liquid ejecting apparatus in which it is possible to facilitate mounting and dismounting of the liquid ejecting head and the landing accuracy of liquid is improved by aligning the liquid ejecting surfaces of a plurality of the liquid ejecting heads.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described in detail based on embodiments.

Embodiment 1

Figure 1:
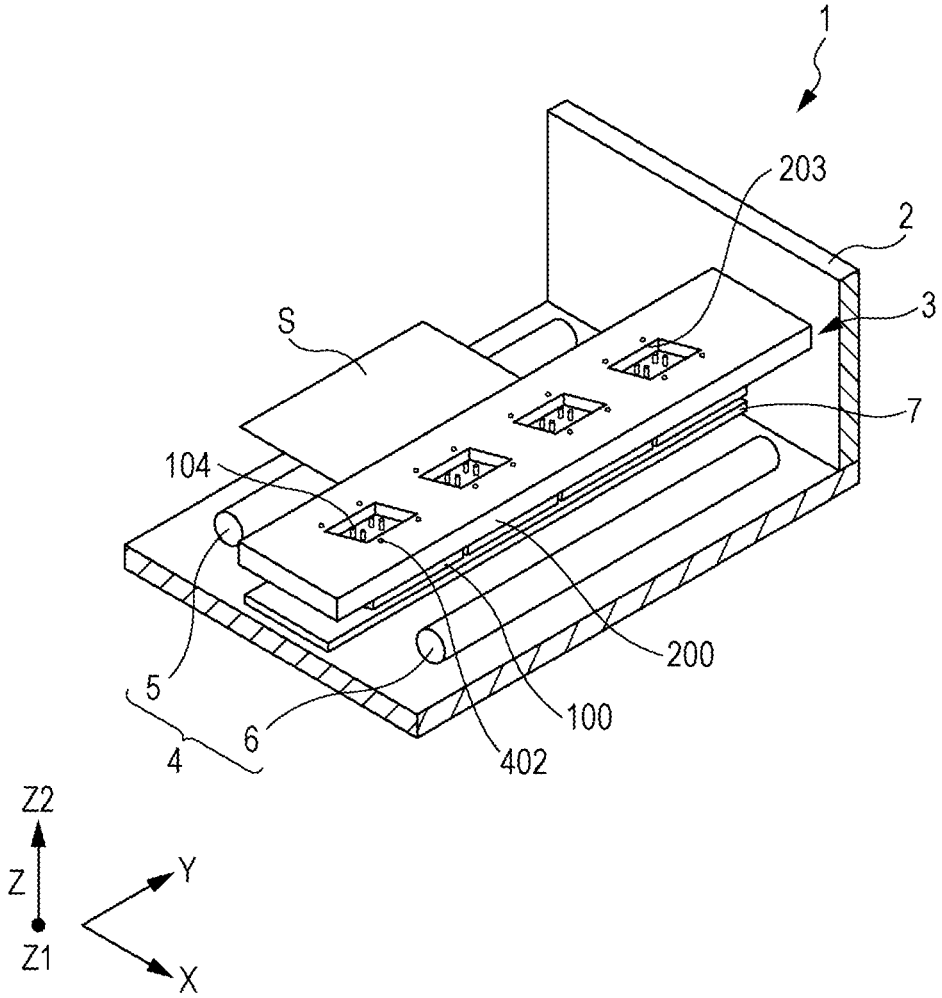
FIG. 1 is a schematic perspective view of a recording apparatus according to Embodiment 1 of the invention.

FIG. 1 is a perspective view showing a schematic configuration of an ink jet type recording apparatus which is an example of a liquid ejecting apparatus according to Embodiment 1 of the invention.

An ink jet type recording apparatus which is an example of a liquid ejecting apparatus according to this embodiment is a so-called line type recording apparatus which performs printing by transporting a recording sheet S such as paper which is a recording medium, while an ink jet type recording head unit which is an example of a liquid ejecting head unit is fixed.

Specifically, as shown in FIG. 1, an ink jet type recording apparatus 1 is provided with an apparatus main body 2, an ink jet type recording head unit 3 (hereinafter also referred to simply as a head unit 3) provided with a plurality of ink jet type recording heads 100 and fixed to the apparatus main body 2, transport means 4 which transports the recording sheet S, and a supporting member 7 which supports the recording sheet S facing the head unit 3. In addition, in this embodiment, a transport direction of the recording sheet S is referred to as a first direction X. Further, a direction orthogonal to the first direction X in an in-plane direction in which a nozzle opening of the head unit 3 is open is referred to as a second direction Y. In addition, a direction orthogonal to the first direction X and the second direction Y is referred to as a third direction Z. Further, in a plane which includes the third direction Z, a liquid ejecting direction side (the recording sheet S side with respect to the head unit 3) is referred to as a Z1 side and the opposite side is referred to as a Z2 side.

The head unit 3 is provided with the plurality of ink jet type recording heads 100, and a head fixing substrate 200 which retains the plurality of ink jet type recording heads 100.

The plurality of ink jet type recording heads 100 are arranged side by side in the second direction Y orthogonal to the first direction X which is the transport direction of the recording sheet S, and are fixed to the head fixing substrate 200. In addition, in this embodiment, the plurality of ink jet type recording heads 100 are arranged side by side on a straight line in the second direction Y. That is, the plurality of ink jet type recording heads 100 are not disposed to be shifted in the first direction X. In this way, the width in the first direction X of the head unit 3 is narrowed, and thus it is possible to attain a reduction in the size of the head unit 3.

Further, the head fixing substrate 200 retains the plurality of ink jet type recording heads 100 on the surface side opposite to a liquid ejecting surface 112 with nozzle openings 111 of the plurality of ink jet type recording heads 100 provided therein, such that the liquid ejecting surface with the nozzle openings 111 of the plurality of ink jet type recording heads 100 formed therein faces the recording sheet S side. The head fixing substrate 200 is fixed to the apparatus main body 2.

The transport means 4 transports the recording sheet S in the first direction X with respect to the head unit 3. The transport means 4 is provided with, for example, a first transport roller 5 and a second transport roller 6 provided on both sides in the first direction X with respect to the head unit 3.

The recording sheet S is transported by the first transport roller 5 and the second transport roller 6. In addition, the transport means 4 for transporting the recording sheet S is not limited to a transport roller and may be a belt, a drum, or the like.

The supporting member 7 supports the recording sheet S which is transported by the transport means 4, at a position facing the head unit 3. The supporting member 7 is made of, for example, metal, resin, or the like having a rectangular cross-section and provided to face the head unit 3 between the first transport roller 5 and the second transport roller 6.

In addition, adsorption means for adsorbing the transported recording sheet S on the supporting member 7 may be provided in the supporting member 7. As the adsorption means, means for suctioning and adsorbing the recording sheet S, means for electrostatically adsorbing the recording sheet S by an electrostatic force, or the like can be given as an example. For example, in a case where the transport means 4 is a belt or a drum, the supporting member 7 supports the recording sheet S on the belt or the drum at a position facing the head unit 3.

Further, although not shown in the drawings, liquid storage means such as an ink tank or an ink cartridge in which ink is stored is connected to each of the ink jet type recording heads 100 of the head unit 3 so as to be able to supply ink. The liquid storage means may be held on, for example, the head unit 3 and may also be held at a position different from the head unit 3 in the apparatus main body 2. Further, a flow path or the like for supplying ink supplied from the liquid storage means to the ink jet type recording head 100 may be provided in the head fixing substrate 200, and separately from the head fixing substrate 200, a flow path member may also be provided so as to supply the ink from the liquid storage means to the ink jet type recording head 100 through the flow path member. Of course, ink may be directly supplied from the liquid storage means to the ink jet type recording head 100 without passing through the head fixing substrate 200 or a flow path member or the like fixed to the head fixing substrate 200.

In the ink jet type recording apparatus 1 according to this embodiment, the recording sheet S is transported by the first transport roller 5 and printing is executed on the recording sheet S supported on the supporting member 7 by the head unit 3. The recording sheet S which has been printed is transported by the second transport roller 6.

Figure 2:
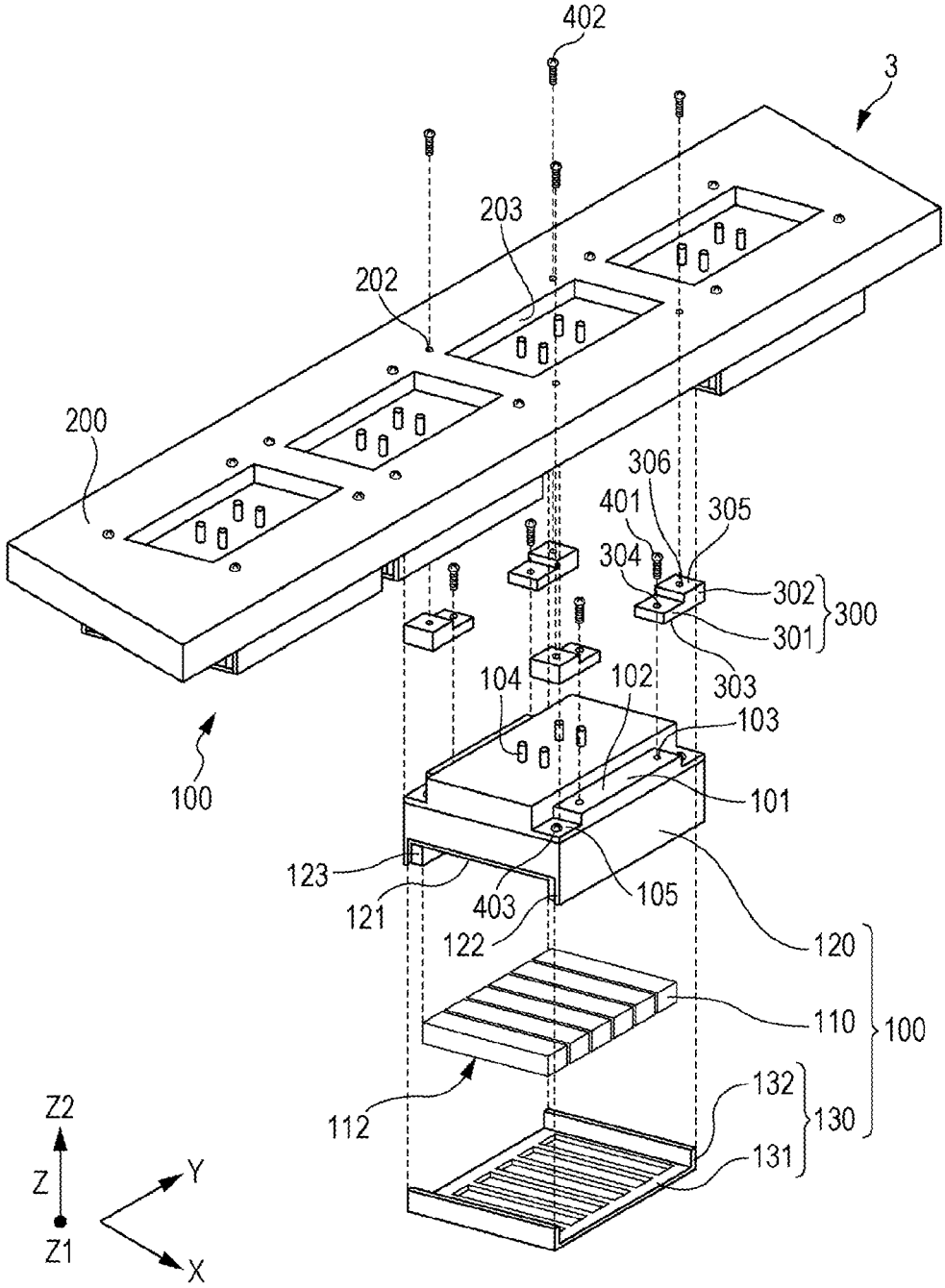
FIG. 2 is a perspective view of a head unit according to Embodiment 1 of the invention.
Figure 3:
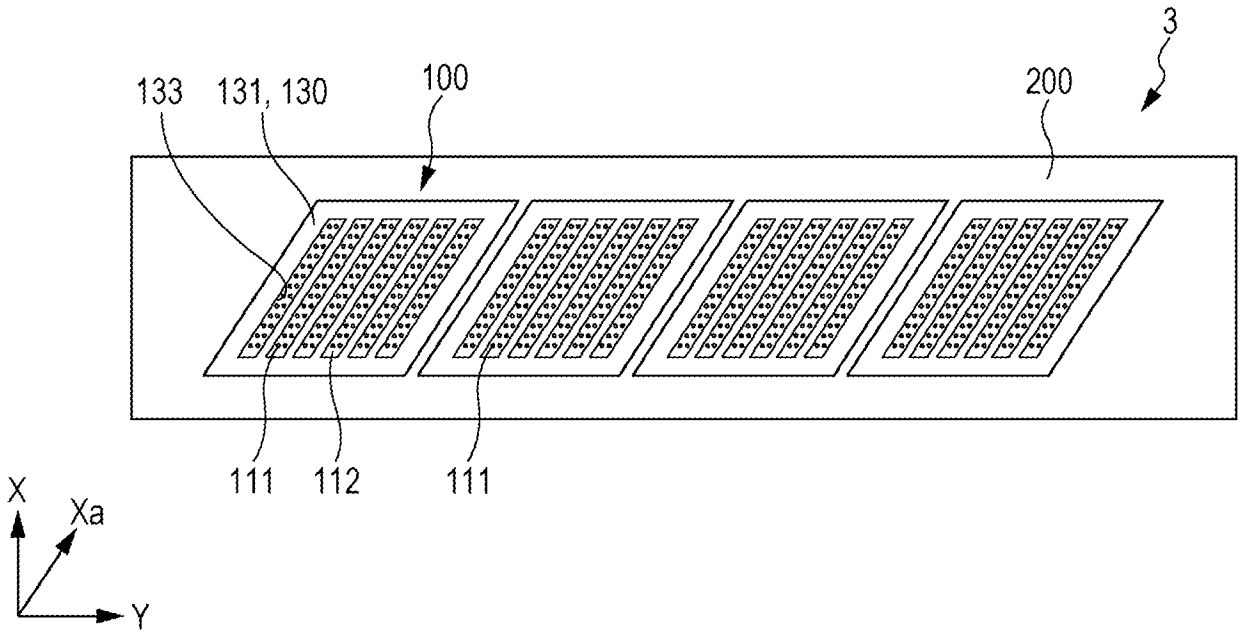
FIG. 3 is a plan view of the head unit according to Embodiment 1 of the invention.
Figure 4:
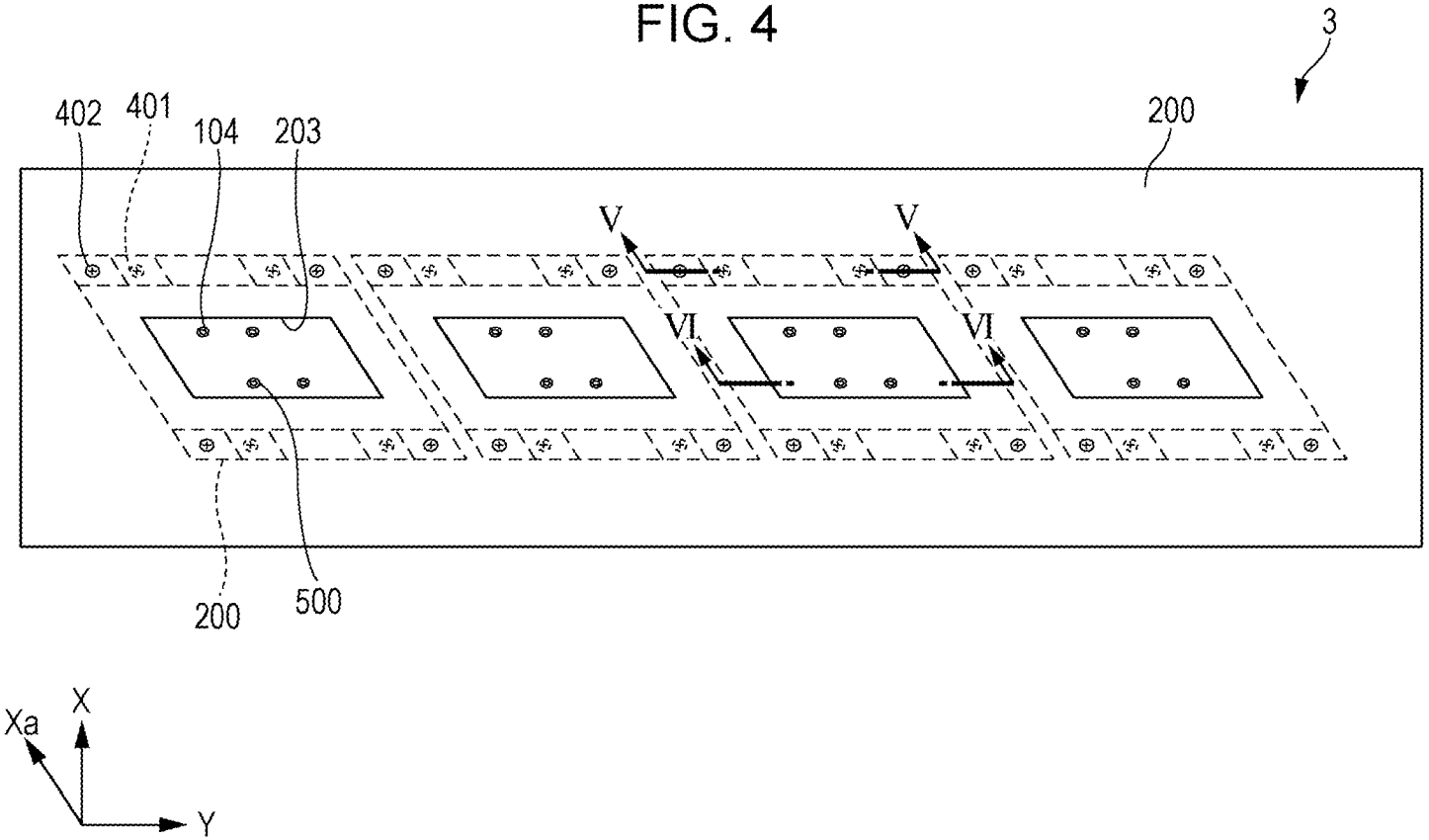
FIG. 4 is a plan view of the head unit according to Embodiment 1 of the invention.

Here, the head unit 3 which is mounted on the ink jet type recording apparatus 1 will be described in detail further referring to FIGS. 2 to 6. In addition, FIG. 2 is an exploded perspective view showing the ink jet type recording head unit which is an example of the liquid ejecting head unit according to Embodiment 1 of the invention, FIG. 3 is a plan view of the liquid ejecting surface side of the ink jet type recording head unit, FIG. 4 is a plan view of the head fixing substrate side of the ink jet type recording head unit, FIGS. 5A and 5B respectively are a cross-sectional view taken along line VA-VA of FIG. 4 and an enlarged view thereof, and FIG. 6 is a cross-sectional view taken along line VI-VI of FIG. 4.

As shown in the drawings, the head unit 3 according to this embodiment is provided with the plurality of ink jet type recording heads 100, the head fixing substrate 200 which retains the plurality of ink jet type recording heads 100, and a spacer 300 which is a height changing-fixing section provided between the head fixing substrate 200 and the ink jet type recording head 100.

The ink jet type recording head 100 has the liquid ejecting surface 112 with the nozzle openings 111 provided therein, on the Z1 side of the third direction Z. In addition, the nozzle openings 111 and the liquid ejecting surface 112 are provided in a head main body 110 (described in detail later) provided in the ink jet type recording head 100. Further, the ink jet type recording head 100 in this embodiment is formed such that the outline thereof has substantially the same size between the Z1 side which is the liquid ejecting surface 112 side and the Z2 side which is the head fixing substrate 200 side. That is, the side surfaces on both sides in the first direction X and the side surfaces on both sides in the second direction Y of the ink jet type recording head 100 are formed so as to be substantially flat surfaces along the third direction Z.

The ink jet type recording head 100 is fixed to the surface side facing the recording sheet S, that is, the Z1 side which is the recording sheet S side in the third direction Z, of the head fixing substrate 200 through the spacer 300. Further, the ink jet type recording head 100 is fixed to the head fixing substrate 200 with the surface on the Z2 side which is the side opposite to the liquid ejecting surface 112 coming into contact with the spacer 300.

The spacer 300 is provided with a first fixing portion 301, and a second fixing portion 302 which is thicker than the first fixing portion 301 in the third direction Z.

The spacer 300 is fixed with a first surface 303 on the Z1 side coming into contact with the surface on the Z2 side which is the side opposite to the liquid ejecting surface 112 of the ink jet type recording head 100. In this embodiment, a first concave portion 101 which is open in the surface on the Z2 side of the ink jet type recording head 100 is provided, the spacer 300 is inserted into the first concave portion 101, and the first surface 303 of the spacer 300 is fixed to be brought into contact with a bottom surface 102 which is the Z1 side in the third direction Z of the first concave portion 101.

Here, a first insertion hole 304 penetrating in the third direction Z is provided in the first fixing portion 301. Further, a first fixing hole 103 which is open in the bottom surface 102 of the first concave portion 101 is provided in the ink jet type recording head 100. Then, a first screw member 401 which is a male screw is inserted from the Z2 side of the first fixing portion 301 and screwed into the first fixing hole 103 of the ink jet type recording head 100, whereby the first surface 303 of the spacer 300 is fixed in a state of coming into contact with the bottom surface 102 of the first concave portion 101 of the ink jet type recording head 100. That is, the spacer 300 is detachably fixed to the ink jet type recording head 100 by the screwing by the first screw member 401 from the Z2 side of the spacer 300. That is, the spacer 300 in this embodiment can be detached from the ink jet type recording head 100 at a desired timing by releasing the screwing by the first screw member 401. In addition, in this embodiment, a configuration is made so as to insert the first screw member 401 into the first insertion hole 304 of the spacer 300 and screw the first screw member 401 into the first fixing hole 103 of the ink jet type recording head 100. However, it is not particularly limited thereto. For example, a first screw member is fixed such that the tip thereof protrudes toward the spacer 300 on the surface on the Z2 side of the ink jet type recording head 100. Then, the spacer 300 may be detachably fixed to the ink jet type recording head 100 by inserting the first screw member into the first insertion hole 304 from the first surface 303 side of the spacer 300 and screwing a nut which is a female screw onto the tip of the inserted first screw member. In this manner, in either of a case of inserting and screwing the first screw member 401 from the Z2 side which is the side opposite to the ink jet type recording head 100, of the spacer 300, and a case of inserting the first screw member from the Z1 side of the spacer 300 and performing screwing by the nut which is a female screw on the Z2 side of the spacer 300, the spacer 300 and the ink jet type recording head 100 are fixed to each other by screwing from the Z2 side which is the surface side opposite to the ink jet type recording head 100, of the spacer 300.

The spacer 300 is disposed at a position which falls within the outline of the ink jet type recording head 100 in the second direction Y which is an arrangement direction of the ink jet type recording heads 100, when viewed from the third direction Z which is a direction orthogonal to the liquid ejecting surface 112. That is, when viewed from the third direction Z, the spacer 300 is disposed at a position which does not protrude from the outline of the ink jet type recording head 100 in the second direction Y. In this embodiment, the spacer 300 is fixed so as to fall within the first concave portion 101 provided on the surface side opposite to the liquid ejecting surface 112 of the ink jet type recording head 100, whereby the spacer 300 is disposed at a position which does not protrude from the side surface in the second direction Y of the ink jet type recording head 100. In addition, the outline of the ink jet type recording head 100 refers to portions which most protrude in the first direction X and the second direction Y, of the ink jet type recording head 100. In this embodiment, although details will be described later, the ink jet type recording head 100 has the plurality of head main bodies 110 having the liquid ejecting surfaces 112, a holder 120 which is a holding member to hold the head main bodies 110, and a cover 130 provided on the liquid ejecting surface 112 side of the head main body 110 and exposing the liquid ejecting surface 112. However, the outline in the second direction Y of the ink jet type recording head 100 refers to portions which most protrude in the second direction Y, among the head main body 110, the holder 120, the cover 130, and the like. Incidentally, the ink jet type recording head 100 in this embodiment is formed such that the outline thereof has substantially the same size between the Z1 side which is the liquid ejecting surface 112 side and the Z2 side which is the head fixing substrate 200 side, as described above, and therefore, it is favorable if the spacer 300 is disposed so as not to protrude from, for example, the holder 120 in the second direction Y.

In this manner, by disposing the spacer 300 at a position which does not protrude from the side surface in the second direction Y of the ink jet type recording head 100 when viewed from the third direction Z, it is possible to narrow the distance between the ink jet type recording heads 100 adjacent to each other in the second direction Y. In this way, it is possible to closely provide the head main bodies 110 of the ink jet type recording heads 100 adjacent to each other in the second direction Y, and thus it is possible to provide the nozzle openings 111 provided in the respective head main bodies 110 of the ink jet type recording heads 100 adjacent to each other, in close proximity to each other in the second direction Y, and although details will be described later, it is possible to continuously form dots arranged side by side at regular intervals in the second direction Y of the head unit 3.

Incidentally, in a case where the spacer 300 is provided so as to protrude from the side surface in the second direction Y of the ink jet type recording head 100 when viewed from the third direction Z, in order to cause the spacers 300 of the ink jet type recording heads 100 adjacent to each other on a straight line in the second direction Y not to interfere with each other, the distance between the ink jet type recording heads 100 adjacent to each other in the second direction Y cannot help but be widened, and thus there is a concern that dots arranged side by side at regular intervals in the second direction Y of the head unit 3 may not be able to be continuously formed, and the size in the second direction Y of the head unit 3 increases.

Further, in this embodiment, the spacer 300 is disposed at a position which falls within the outline on the liquid ejecting surface 112 side of the ink jet type recording head 100 in the first direction X which is a relative movement direction of the recording sheet S with respect to the head unit 3, that is, the transport direction of the recording sheet S, when viewed from the third direction Z which is a direction orthogonal to the liquid ejecting surface 112. In this way, it is possible to reduce the width in the first direction X of the head unit 3, and it is possible to reduce the distance in the first direction X between the first transport roller 5 and the second transport roller 6 in the ink jet type recording apparatus 1. Therefore, the fixing of the posture of the recording sheet S between the first transport roller 5 and the second transport roller 6 becomes easy, and thus it is possible to improve printing quality. Further, it becomes possible to reduce the sizes of the head unit 3 and the ink jet type recording apparatus 1. In addition, the outline of the liquid ejecting surface 112 of the ink jet type recording head 100 refers to portions which most protrude in the first direction X and the second direction Y on the liquid ejecting surface 112 side in the third direction Z of the ink jet type recording head 100. In this embodiment, the ink jet type recording head 100 has the head main body 110 having the liquid ejecting surface 112, the holder 120 which retains the head main body 110, and the cover 130 provided on the liquid ejecting surface 112 side of the head main body 110 and exposing the liquid ejecting surface 112. Then, the ink jet type recording head 100 in this embodiment is formed such that the outline thereof has substantially the same size between the Z1 side which is the liquid ejecting surface 112 side and the Z2 side which is the head fixing substrate 200 side. Therefore, the outline on the liquid ejecting surface 112 side of the ink jet type recording head 100 in this embodiment is the outline of the cover 130 or the outline on the cover 130 side of the holder 120. However, in a case where the outline on the Z2 side protrudes in the first direction X further than the outline on the Z1 side which is the liquid ejecting surface 112 side of the ink jet type recording head 100 in the third direction Z, the outline on the liquid ejecting surface 112 side of the ink jet type recording head 100 becomes the outline of a portion which is provided on the Z2 side and protrudes in the first direction X. However, in a case where the ink jet type recording head 100 is provided to protrude in the first direction X at a position which does not interfere with the first transport roller 5 and the second transport roller 6, the protruding portion is not called the outline on the liquid ejecting surface 112 side. That is, the outline on the liquid ejecting surface 112 side of the ink jet type recording head 100 is the outline at a position which interferes with the first transport roller 5 and the second transport roller 6.

The spacer 300 is detachably fixed in a state where a second surface 305 on the side opposite to the first surface 303 of the second fixing portion 302 comes into contact with a fixing surface 201 on the Z1 side which is the recording sheet S side of the head fixing substrate 200. In this way, the ink jet type recording head 100 is detachably fixed to the head fixing substrate 200 through the spacer 300.

Here, a second fixing hole 306 which is open to the head fixing substrate 200 side is provided in the second fixing portion 302 of the spacer 300. Further, in the head fixing substrate 200, a second insertion hole 202 is provided at a position facing the second fixing hole 306 in the third direction Z. Then, a second screw member 402 which is male screw is inserted from the Z2 side of the head fixing substrate 200 and screwed into the second fixing hole 306 provided in the spacer 300, whereby the spacer 300 is fixed in a state where the second surface 305 comes into contact with the fixing surface 201 of the head fixing substrate 200. That is, the spacer 300 is detachably fixed by the screwing by the second screw member 402 from the Z2 side of the head fixing substrate 200. That is, the spacer 300 in this embodiment can be detached from the head fixing substrate 200 at a desired timing by releasing the screwing of the second screw member 402. In addition, in this embodiment, a configuration is made so as to insert the second screw member 402 into the second insertion hole 202 of the head fixing substrate 200 and screw the second screw member 402 into the second fixing hole 306 of the spacer 300. However, it is not particularly limited thereto. For example, a second screw member is fixed such that the tip thereof protrudes toward the head fixing substrate 200 side on the surface on the Z2 side of the spacer 300. Then, the spacer 300 may be detachably fixed to the head fixing substrate 200 by inserting the second screw member into the second insertion hole 202 from the Z1 side of the head fixing substrate 200 and screwing a nut which is a female screw onto the tip of the inserted second screw member. In this manner, in either of a case of inserting and screwing the second screw member 402 from the Z2 side of the head fixing substrate 200 and a case of inserting the second screw member from the Z1 side of the head fixing substrate 200 and performing screwing by the nut which is a female screw on the Z2 side of the head fixing substrate 200, the head fixing substrate 200 and the spacer 300 are fixed to each other by the screwing from the Z2 side which is the surface side opposite to the ink jet type recording head 100, of the head fixing substrate 200.

Then, as described above, by detachably providing the spacer 300 at the ink jet type recording head 100 and detachably providing the spacer 300 at the head fixing substrate 200, it is possible to easily mount and dismount the ink jet type recording head 100 on and from the head fixing substrate 200. In this way, when the plurality of ink jet type recording heads 100 provided in the head unit 3 has failed, it becomes possible to selectively replace only the ink jet type recording head 100 which has broken. That is, since it is not necessary to replace the entirety of the head unit 3 due to the failure of one ink jet type recording head 100, it is possible to reduce the cost. Further, also during the assembling of the head unit 3, it becomes possible to selectively replace the ink jet type recording head 100 in which the ejection characteristics of ink droplets are uneven, and thus it is possible to improve yield. That is, if variation is present in the ejection characteristics of ink droplets of the plurality of ink jet type recording heads 100 incorporated into the head unit 3, printing quality is degraded. However, this is because there is a case where the measurement of an ejection characteristic or the inspection of printing quality is performed in a state where the ink jet type recording heads 100 are assembled into the head unit 3. Further, since an adhesive is not used for the fixing of the ink jet type recording head 100 to the head fixing substrate 200, it is not necessary to perform complicated management of the thickness, protrusion, or the like of an adhesive, and thus it is possible to simplify an assembling process.

Further, in this embodiment, since the spacer 300 fixed to the ink jet type recording head 100 is fixed to the head fixing substrate 200 by screwing from the surface side opposite to the fixing surface 201 on the Z1 side, it is possible to dispose the spacer 300 so as to fall within the outline in the second direction Y of the ink jet type recording head 100 without causing the spacer 300 to protrude from the second direction Y on the liquid ejecting surface 112 side of the ink jet type recording head 100. Therefore, it is possible to narrow the distance between the ink jet type recording heads 100 arranged side by side in the second direction Y and adjacent to each other, and it is possible to reduce the width in the first direction X of the head unit 3. Incidentally, for example, in a case where an attempt to fix the spacer 300 fixed to the ink jet type recording head 100, by screwing from the Z1 side, is made, the first surface 303 has to be exposed by causing the spacer 300 to protrude from either one or both of the first direction X and the second direction Y of the ink jet type recording head 100. For example, if the spacer 300 protrudes from the second direction Y of the ink jet type recording head 100, the distance between the ink jet type recording heads 100 which are arranged side by side in the second direction Y becomes wider. Further, if the spacer 300 protrudes from the first direction X of the ink jet type recording head 100, the width in the first direction X of the head unit 3 becomes larger.

Further, in this embodiment, both the first screw member 401 fixing the spacer 300 to the ink jet type recording head 100 and the second screw member 402 fixing the head fixing substrate 200 to the spacer 300 are detachably fixed by screwing from the side opposite to the liquid ejecting surface 112 of the ink jet type recording head 100. Therefore, it is possible to prevent trouble such as ink stuck to the first screw member 401 or the second screw member 402 falling to the recording sheet S or the like at an unexpected timing. Further, since the first screw member 401 and the second screw member 402 have the same screwing direction, workability is good.

In addition, it is favorable if a difference in thickness between the first fixing portion 301 and the second fixing portion 302 in the third direction Z of the spacer 300 is larger than a head portion of the first screw member 401 which is inserted into and fixed to the first fixing portion 301. In this way, when the spacer 300 fixed to the ink jet type recording head 100 has been fixed to the head fixing substrate 200, the first screw member 401 can be prevented from coming into contact with the head fixing substrate 200.

Further, the first concave portion 101 which is provided in the ink jet type recording head 100 and into which the spacer 300 is inserted is formed to be shallower than the thickness of the second fixing portion 302 in the third direction Z. In this way, when the spacer 300 has been inserted into and fixed to the first concave portion 101, the second surface 305 of the spacer 300 protrudes further to the Z2 side than the surface on the side opposite to the liquid ejecting surface 112 of the ink jet type recording head 100, and therefore, when the spacer 300 has been fixed to the head fixing substrate 200, the ink jet type recording head 100 can be prevented from coming contact with the head fixing substrate 200. Therefore, it is possible to adjust the height in the third direction Z of the liquid ejecting surface 112 of the ink jet type recording head 100 and the inclination of the liquid ejecting surface 112 by using the spacer 300 having a different thickness. That is, this is because if the ink jet type recording head 100 comes into contact with the head fixing substrate 200 ahead of the spacer 300, it is not possible to perform the adjustment of the height in the third direction Z of the liquid ejecting surface 112 of the ink jet type recording head 100 with respect to the head fixing substrate 200 by using the spacer 300 having a different thickness.

In this manner, the spacer 300 fixed to the ink jet type recording head 100 is fixed to be brought into contact with the fixing surface 201 of the head fixing substrate 200 without bringing the ink jet type recording head 100 into contact with the head fixing substrate 200, whereby it is possible to adjust the distance in the third direction Z between the ink jet type recording head 100 and the head fixing substrate 200 by using the spacer 300 in which the thickness of the second fixing portion 302 is different. That is, if the spacer 300 is used in which the thickness in the third direction Z of the second fixing portion 302 is relatively thin, it is possible to narrow the distance between the ink jet type recording head 100 and the head fixing substrate 200, and if the spacer 300 is used in which the thickness in the third direction Z of the second fixing portion 302 is relatively thick, it is possible to widen the distance between the ink jet type recording head 100 and the head fixing substrate 200. That is, the spacer 300 in this embodiment is height changing means capable of adjusting the distance between the ink jet type recording head 100 and the head fixing substrate 200 and is also fixing means for fixing the ink jet type recording head 100 to the head fixing substrate 200, and becomes the height changing-fixing section including these two means.

In this manner, since it is possible to adjust the height of the liquid ejecting surface 112 of the ink jet type recording head 100 which is fixed to the head fixing substrate 200 by the spacer 300, it is possible to easily align the heights in the third direction Z with respect to the recording sheet S, of the liquid ejecting surfaces 112 of the plurality of ink jet type recording heads 100 which are fixed to the head fixing substrate 200. Therefore, it is possible to improve printing quality by preventing misalignment of landing positions of ink droplets which are ejected from the respective ink jet type recording heads 100.

Further, in this embodiment, a configuration is made such that four spacers 300 are provided with respect to one ink jet type recording head 100. Specifically, a configuration is made such that the spacer 300 is provided at each of four corner portions in a plane in the first direction X and the second direction Y of the ink jet type recording head 100. In this manner, the four spacers 300 are provided with respect to one ink jet type recording head 100, and also with respect to the four spacers 300, the spacers 300 having different thicknesses are used, whereby it is possible to adjust the inclination of the liquid ejecting surface 112 of the ink jet type recording head 100. That is, in a case where as the two spacers 300 which are provided on one end portion side in the first direction X, the spacers 300 in which the thickness of the second fixing portion 302 is relatively thin are used, and as the two spacers 300 which are provided on the other end portion side in the first direction X, the spacers 300 in which the thickness of the second fixing portion 302 is relatively thick are used, the liquid ejecting surface 112 is inclined so as to face one end portion side in the first direction X. By likewise performing adjustment in the second direction Y as well, it is possible to incline the liquid ejecting surface 112 in an optional direction. That is, by using the four spacers 300 with respect to one ink jet type recording head 100, it is possible to align the inclinations of the liquid ejecting surfaces 112 of the plurality of ink jet type recording heads 100 which are fixed to the head fixing substrate 200. Therefore, since it is possible to easily align the inclinations with respect to the recording sheet S, of the liquid ejecting surfaces 112 of the plurality of ink jet type recording heads 100 which are fixed to the head fixing substrate 200, it is possible to improve printing quality by preventing misalignment of landing positions of ink droplets which are ejected from the respective ink jet type recording heads 100.

Here, the ink jet type recording head 100 is configured by stacking a plurality of members, and thus due to dimensional tolerance of each member, variation in the thickness of an adhesive, or the like, there is a case where a dimension in the third direction Z is different or a case where the liquid ejecting surface 112 is obliquely provided. For this reason, if the plurality of ink jet type recording heads 100 are fixed to a common head fixing substrate 200 by using the spacers 300 having the same thickness, variation occurs in the heights in the third direction Z of the liquid ejecting surfaces 112 of the plurality of ink jet type recording heads 100, or variation occurs in the inclinations of the liquid ejecting surfaces 112. Such variation in the liquid ejecting surfaces 112 is a problem unique to the head unit of this embodiment in which the surface on the side opposite to the liquid ejecting surface 112 is fixed to the head fixing substrate 200, and for example, in a head unit in which the liquid ejecting surfaces 112 of the plurality of ink jet type recording heads are held by a common member, such a problem does not occur. However, in a case where the liquid ejecting surfaces 112 of the plurality of ink jet type recording heads are held by a common member, the distance between the liquid ejecting surface 112 and the recording sheet S becomes wider by an amount corresponding to the dimension of the common member, and thus there is a case where a problem such as the landing accuracy of ink droplets being reduced occurs. Further, the sizes of the head unit 3 and the ink jet type recording apparatus 1 may increase in the first direction X by an amount corresponding to the dimension of the common member. In this embodiment, since the surface side opposite to the liquid ejecting surface 112, rather than the liquid ejecting surface 112, is fixed to the head fixing substrate 200, it is possible to narrow the distance between the liquid ejecting surface 112 and the recording sheet S, and it is possible to improve the landing accuracy of ink droplets onto the recording sheet S. Further, it is possible to attain a reduction in the size of the head unit 3 by narrowing the width in the first direction X of the head unit 3.

In this embodiment, one ink jet type recording head 100 is fixed to the head fixing substrate 200 by using the plurality of spacers 300, whereby it is possible to easily suppress variation in the height of the liquid ejecting surface 112 of the ink jet type recording head 100 which is fixed to the head fixing substrate 200 or variation in the inclination of the liquid ejecting surface 112. Therefore, it is possible to perform highly accurate landing by preventing misalignment of the landing positions of ink droplets onto the recording sheet S. That is, in a case of bonding the ink jet type recording head 100 to the head fixing substrate 200 by using an adhesive, the heights or the inclinations of the liquid ejecting surfaces 112 of the plurality of ink jet type recording heads 100 have to be adjusted according to the thickness of the adhesive, and thus it is not possible to perform highly accurate adjustment. Further, since the thickness of the adhesive and the adjustment of the height or the inclination of the liquid ejecting surface 112 are related to each other, there is a concern that a problem such as protrusion of the adhesive may occur due to performing the adjustment of the height or the inclination of the liquid ejecting surface 112. In addition, since there is a limit of a thickness in an adhesive, there is a case where it is not possible to uniformly align the liquid ejecting surfaces 112 with only an adhesive. In this embodiment, since it is possible to easily and accurately adjust the height or the inclination of the liquid ejecting surface 112 of the ink jet type recording head 100 by using the spacer 300 which is the height changing-fixing section, it is possible to prevent trouble due to the protrusion of an adhesive or trouble such as being unable to align the heights of the liquid ejecting surfaces 112 due to a limit of the thickness of an adhesive.

In addition, at least three spacers are provided with respect to one ink jet type recording head 100, whereby it is possible to adjust the inclination in all directions of the liquid ejecting surface 112. However, as in this embodiment, the four spacers 300 are provided corresponding to four corners of the ink jet type recording head 100, whereby the adjustment of the inclination of the liquid ejecting surface 112 becomes easier and it is possible to solidly fix the ink jet type recording head 100 to the head fixing substrate 200. That is, in order to adjust the inclination of the liquid ejecting surface 112 by the spacers 300, it is preferable to dispose the spacers 300 at positions as far away as possible on the fixing surface 201 of the head fixing substrate 200. In this way, it is possible to easily perform fine adjustment of the inclination of the liquid ejecting surface 112. Further, by fixing the ink jet type recording head 100 to the head fixing substrate 200 through the four spacers 300, it is possible to prevent the position of the ink jet type recording head 100 from being easily shifted due to impact or the like.

Further, in this embodiment, the first concave portion 101 into which the spacer 300 is inserted is provided on the side opposite to the liquid ejecting surface 112 of the ink jet type recording head 100, and the spacer 300 is fixed into the first concave portion 101. That is, the first surface 303 on the Z1 side of the spacer 300 comes into contact further on the Z1 side than the surface which most protrudes to the Z2 side, of the ink jet type recording head 100 in the third direction Z. In this way, it is possible to reduce the height in the third direction Z of the head unit. That is, this is because in a case of bringing the first surface of the spacer 300 into contact with the surface which most protrudes to the Z2 side, of the ink jet type recording head 100, without providing the first concave portion 101 in the ink jet type recording head 100, the size of the head unit increases in the third direction Z by an amount corresponding to the spacer 300. Incidentally, in this embodiment, a projection 104 with a flow path 500 provided on the inside thereof is provided on the surface side opposite to the liquid ejecting surface 112 of the ink jet type recording head 100. Since the projection 104 is inserted into a through-hole 203 provided in the head fixing substrate 200, the surface on the side opposite to the liquid ejecting surface 112 of the ink jet type recording head 100 does not include the projection 104. That is, the surface on the side opposite to the liquid ejecting surface 112 of the ink jet type recording head 100 is a surface provided further to the Z1 side in the third direction Z than the fixing surface 201 of the head fixing substrate 200.

Then, as described above, the plurality of ink jet type recording heads 100 are arranged side by side on a straight line in the second direction Y and detachably fixed to the head fixing substrate 200. That is, the plurality of ink jet type recording heads 100 are not disposed to be shifted in the first direction X. In this way, it is possible to attain a reduction in the size of the head unit 3 by narrowing the width in the first direction X of the head unit 3. Of course, the ink jet type recording heads 100 arranged side by side in the second direction Y may be disposed to be shifted in the first direction X. However, if the ink jet type recording head 100 is greatly shifted in the first direction X, the width in the first direction X of the head fixing substrate 200 or the like becomes wider. In this manner, if the size in the first direction X of the head unit 3 becomes larger, the distance in the first direction X between the first transport roller 5 and the second transport roller 6 in the ink jet type recording apparatus 1 becomes more distant, and thus the fixing of the posture of the recording sheet S becomes difficult. Further, the sizes of the head unit 3 and the ink jet type recording apparatus 1 increase.

In addition, in this embodiment, a configuration is made such that the four ink jet type recording heads 100 are fixed to the head fixing substrate 200. However, as long as the number of ink jet type recording heads 100 is two or more, it is not particularly limited thereto.

Here, an example of the ink jet type recording head 100 which is mounted on such a head unit will be described in more detail.

As shown in FIGS. 2, 5A, 5B, and 6, the ink jet type recording head 100 is provided with the plurality of head main bodies 110, the holder 120 which is a holding member in this embodiment, which holds the plurality of head main bodies 110, and the cover 130 provided on the liquid ejecting surface 112 side of the head main body 110.

The head main body 110 has the liquid ejecting surface 112 with the nozzle openings 111 provided therein on the Z1 side in the third direction Z. Further, the Z2 sides of the plurality of head main bodies 110 are bonded to the surface on the Z1 side of the holder 120.

The holder 120 has a holding portion 121 forming a groove-like space on the Z1 side. The holding portion 121 is continuously provided over the second direction Y on the surface on the Z1 side of the holder 120, thereby being provided to be open in both side surfaces in the second direction Y. Further, in the holder 120, the holding portion 121 is provided at substantially the central portion in the first direction X, whereby foot portions 122 are formed on both sides in the first direction X of the holding portion 121. That is, the foot portions 122 are provided at only both end portions in the first direction X on the surface on the Z1 side of the holder 120 and are not provided at both end portions in the second direction Y.

The plurality of head main bodies 110 are bonded into the holding portion 121 by an adhesive 140. That is, the foot portions 122 are located on both sides in the first direction X with respect to the head main body 110. In addition, the holder 120 and the head main body 110 are bonded to each other by the adhesive 140 at the surfaces facing each other in the third direction Z. In addition, the flow path 500 or the like which supplies ink to the head main body 110 is provided in the holder 120, and the flow path 500 of the holder 120 and a flow path (not shown) of the head main body 110 are sealed by the adhesive 140 and communicate with each other.

Further, the holder 120 is provided with a first member 125 provided on the Z2 side in the third direction Z, and a second member 126 provided on the Z1 side which is the head main body 110 side.

Then, the first member 125 and the second member 126 are detachably fixed to each other. In this embodiment, the first member 125 and the second member 126 are detachably fixed to each other by performing screwing from the Z2 side which is the side opposite to the second member 126, of the first member 125 in the third direction Z. Specifically, a third insertion hole 127 penetrating in the third direction Z is provided in the first member 125. Further, a third fixing hole 128 facing the third insertion hole 127 in the third direction Z is provided in the second member 126. Then, the first member 125 and the second member 126 are detachably fixed to each other by inserting a third screw member 403 which is a male screw into the third insertion hole 127 from the Z2 side of the first member 125 and screwing the third screw member 403 into the third fixing hole 128 of the second member 126. In addition, the third insertion hole 127 into which the third screw member 403 is inserted, of the first member 125, is provided to be open in the bottom surface in the third direction Z of a second concave portion 105 which is deeper than the first concave portion 101. In this way, when the spacer 300 has been fixed to the holder 120, the third screw member 403 can be prevented from coming into contact with the spacer 300. That is, the depth in the third direction Z of the second concave portion 105 with respect to the bottom surface of the first concave portion 101 is provided so as to be deeper than the thickness of a head portion of the third screw member 403.

In the holder 120, the flow path 500 for supplying ink from the liquid storage means to the head main body 110 is provided over the first member 125 and the second member 126. Then, a filter 501 crossing the flow path 500 is provided on the surface on the second member 126 side of the first member 125. Foreign matter such as dust or air bubbles contained in ink flowing through the flow path 500 is removed by the filter 501. However, if foreign matter enters the flow path of the second member 126 which is further on the downstream side of the flow path than the filter 501 in a manufacturing step or the like before the filter 501 is provided, the foreign matter may clog the nozzle opening 111 provided in the head main body 110.

The ink jet type recording head 100 having the holder 120 can be detached from the head fixing substrate 200 by the spacer 300, as described, and therefore, by dividing the holder 120 of the ink jet type recording head 100 detached from the head fixing substrate 200 into the first member 125 and the second member 126, it is possible to remove foreign matter in the flow path of the second member 126 by cleaning the flow path of the second member 126 which is further on the downstream side of the flow path than the filter 501. That is, even if foreign matter has entered the flow path of the second member 126 to which the plurality of head main bodies 110 are bonded, by dividing the first member 125 and the second member 126, detaching the filter 501 from the second member 126, and removing the foreign matter in the flow path of the second member 126, it is possible to improve the yield of the second member 126 to which the plurality of head main bodies 110 are bonded, compared to a case where the foreign matter in the flow path of the second member 126 cannot be removed. Incidentally, the cleaning of the flow path of the second member 126 can be performed by, for example, backwashing to cause ink to flow back from the nozzle opening 111 side, or the like.

Further, in this embodiment, the first member 125 and the second member 126 are detachably fixed to each other by the screwing by the third screw member 403 from the side opposite to the second member 126, of the first member 125. Therefore, by preventing the third screw member 403 from touching ink, it is possible to prevent trouble such as ink stuck to the third screw member 403 falling to the recording sheet S at an unexpected timing. Further, since the third screw member 403 has the same screwing direction as the first screw member 401 fixing the spacer 300 to the ink jet type recording head 100 or the second screw member 402 fixing the head fixing substrate 200 to the spacer 300, workability is good. In addition, in each of the first member 125 and the second member 126, a plurality of members may be stacked in the third direction Z, and for example, even in a case where the filter 501 is provided at the boundary between the members configuring the first member 125 and the filter 501 is not provided at the boundary between the first member 125 and the second member 126, by dividing the first member 125 and the second member 126, it is possible to detach the filter 501, which is included in the first member 125, from the second member 126 with the plurality of head main bodies 110 bonded thereto.

Although not particularly shown in the drawings, the head main body 110 which is held by the holder 120 is configured by stacking a plurality of members. In the plurality of head main bodies 110, variation occurs in the height in the third direction Z due to dimensional tolerance of the plurality of members configuring each of the head main bodies 110, variation in the thickness of an adhesive or the like for stacking the plurality of members, or the like. In order to hold the plurality of head main bodies 110 in which variation in height has occurred in the third direction Z in this manner, by the holder 120 which is common, and align the liquid ejecting surfaces 112 of the plurality of head main bodies 110 on a plane, that is, align the heights in the third direction Z of the liquid ejecting surfaces 112, it is necessary to absorb variation in the heights of the head main bodies 110 by the adhesive 140 bonding the holder 120 and the head main bodies 110 together.

Incidentally, although it is also conceivable that the holder 120 and the head main body 110 are fixed to each other by a screw or the like, the head main body 110 is small and in this embodiment, it is necessary to mount a plurality of head main bodies with respect to one holder 120, and therefore, it is difficult to perform fixing by a screw or the like through a seal member made of an elastic material. Therefore, the head main body 110 and the holder 120 are bonded to each other by the adhesive 140, whereby it is possible to seal the flow paths which are connected, of the two, with the cost reduced by reducing the number of components, without providing a seal member made of an elastic material between the two.

Further, in the holding portion 121 of the holder 120, the plurality of head main bodies 110 are arranged side by side in the second direction Y and bonded thereto. In this embodiment, the six head main bodies 110 are bonded to one holder 120. Of course, the number of head main bodies 110 which are fixed to one holder 120 is not limited to that described above, and with respect to one holder 120, the head main body 110 may be one or may also be two or more. Incidentally, by attaining a multiple nozzle row by providing the plurality of head main bodies 110 with respect to one ink jet type recording head 100, it is possible to improve yield, compared to a case of attaining a multiple nozzle row by providing a plurality of nozzle rows in only one head main body 110 with respect to one ink jet type recording head 100. That is, attaining a multiple nozzle row in a single head main body 110 causes a reduction in the yield of the head main body 110 and an increase in manufacturing cost. In contrast, by fixing the plurality of head main bodies 110 to a common holder 120, thereby attaining a multiple nozzle row by the plurality of head main bodies 110, it is possible to improve the yield of the head main body 110, thereby reducing the manufacturing cost.

In addition, the plurality of head main bodies 110 in this embodiment are fixed such that a nozzle row is inclined with respect to the first direction X which is the transport direction of the recording sheet S, in an in-plane direction of the liquid ejecting surface 112. That is, a fourth direction Xa which is an arrangement direction of the nozzle openings 111 configuring the nozzle row is a direction inclined with respect to the first direction X. In this embodiment, in the ink jet type recording head 100, the plurality of head main bodies 110 are provided to be arranged side-by side in the second direction Y and at least some of the nozzle openings 111 of the head main bodies 110 adjacent to each other in the second direction Y can be disposed at positions overlapping in the first direction X.

Further, in the outline as viewed from the third direction Z of the ink jet type recording head 100, the side surfaces in the second direction Y are provided at the same inclination as the fourth direction Xa. That is, in the ink jet type recording head 100, when viewed from the third direction Z orthogonal to the liquid ejecting surface 112, the outline which becomes the boundary between the ink jet type recording heads 100 adjacent to each other in the second direction Y is provided to be inclined with respect to the first direction X which is the transport direction of the recording sheet S. That is, when viewed from the third direction Z, the side surfaces which become the outlines on the second direction Y side of the ink jet type recording head 100 are provided with a plane direction thereof inclined in the fourth direction Xa with respect to the first direction X. In this way, at least some of the nozzle openings 111 of the ink jet type recording heads 100 adjacent to each other in the second direction Y can be disposed at positions overlapping in the first direction X.

As a result, it becomes possible to continuously dispose dots formed by landing ink ejected from the respective nozzle openings 111 of the ink jet type recording heads 100 arranged side by side in the second direction Y on the recording sheet S, at regular intervals in the second direction Y. Further, it becomes possible to reduce deterioration of printing quality by making banding capable of occurring at the joint of dots between the ink jet type recording heads 100 adjacent to each other in the second direction Y less noticeable by performing control to alternately perform the ejection from the nozzle openings 111 disposed at positions overlapping in the first direction X or exclusively perform the ejection at a gradient-distributed rate. Thus, it is possible to easily form a long nozzle row in the second direction Y. In addition, in order to dispose at least some of the nozzle openings 111 of the ink jet type recording heads 100 adjacent to each other in the second direction Y at positions overlapping in the first direction X by causing the outline which becomes the boundary between the ink jet type recording heads 100 adjacent to each other in the second direction Y to be inclined along the fourth direction Xa, the spacer 300 can be disposed at a position falling within the outline in the second direction Y of the ink jet type recording head 100 so as not to protrude from the side surface in the second direction Y of the ink jet type recording head 100, as described above.

In addition, the ink jet type recording head 100 in this embodiment has a shape which is an approximately parallelogram shape when viewed in plan view from the liquid ejecting surface 112 side, as shown in FIG. 3. Of course, the shape when viewed in plan view from the liquid ejecting surface 112 side of the ink jet type recording head 100 is not limited to an approximately parallelogram shape and may be a rectangular shape, a trapezoidal shape, a polygonal shape, or the like.

In this manner, the ink jet type recording head unit 3 is made by disposing the plurality of ink jet type recording heads 100, thereby exhibiting the effects such as manufacturing yield, ease of processing, and ease of flattening of a plane of the cover 130 which is a fixing plate.

The cover 130 is equivalent to a fixing plate in this embodiment and is made of a plate-shaped member such as metal. The cover 130 is provided on the liquid ejecting surface 112 side of the ink jet type recording head 100, that is, the Z1 side in the third direction Z of the ink jet type recording head 100.

The cover 130 is formed by bending a flat plate-shaped member and is provided with a base portion 131 provided on the liquid ejecting surface 112 side, and a bent portion 132 provided by bending both end portions in the second direction Y of the base portion 131 to the Z2 side in the third direction Z.

Figure 5A:
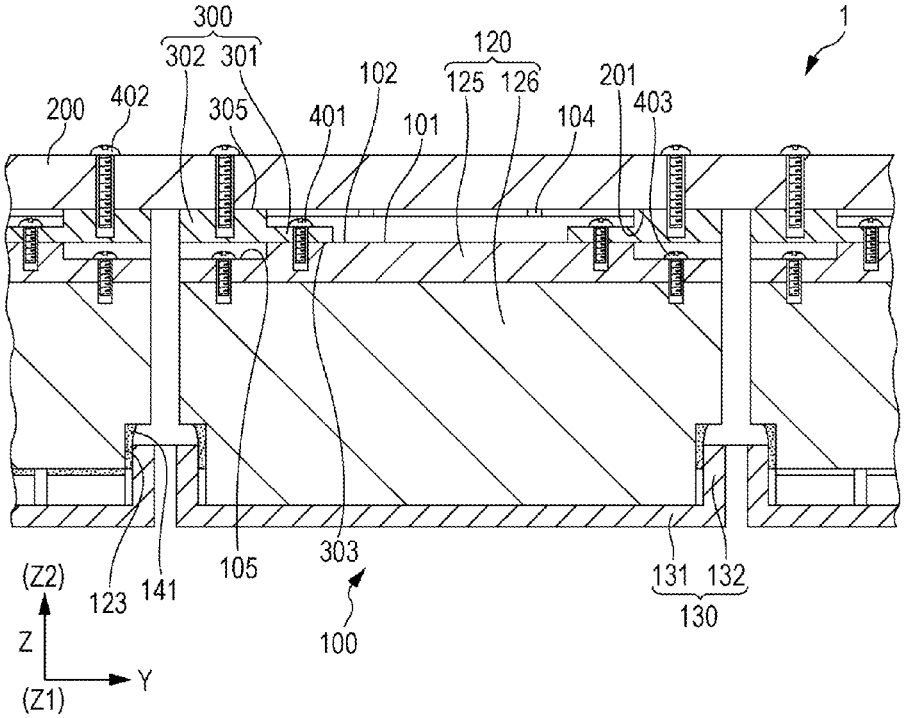
FIGS. 5A and 5B respectively are a cross-sectional view and an enlarged view of the head unit according to Embodiment 1 of the invention.
Figure 5B:
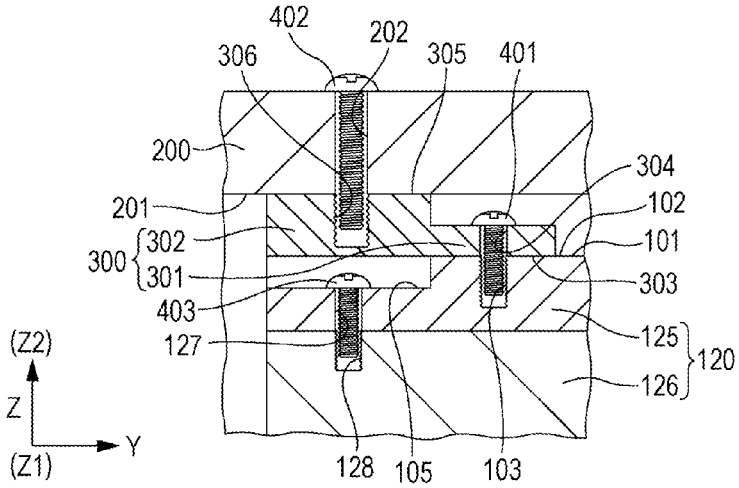
Figure 6:
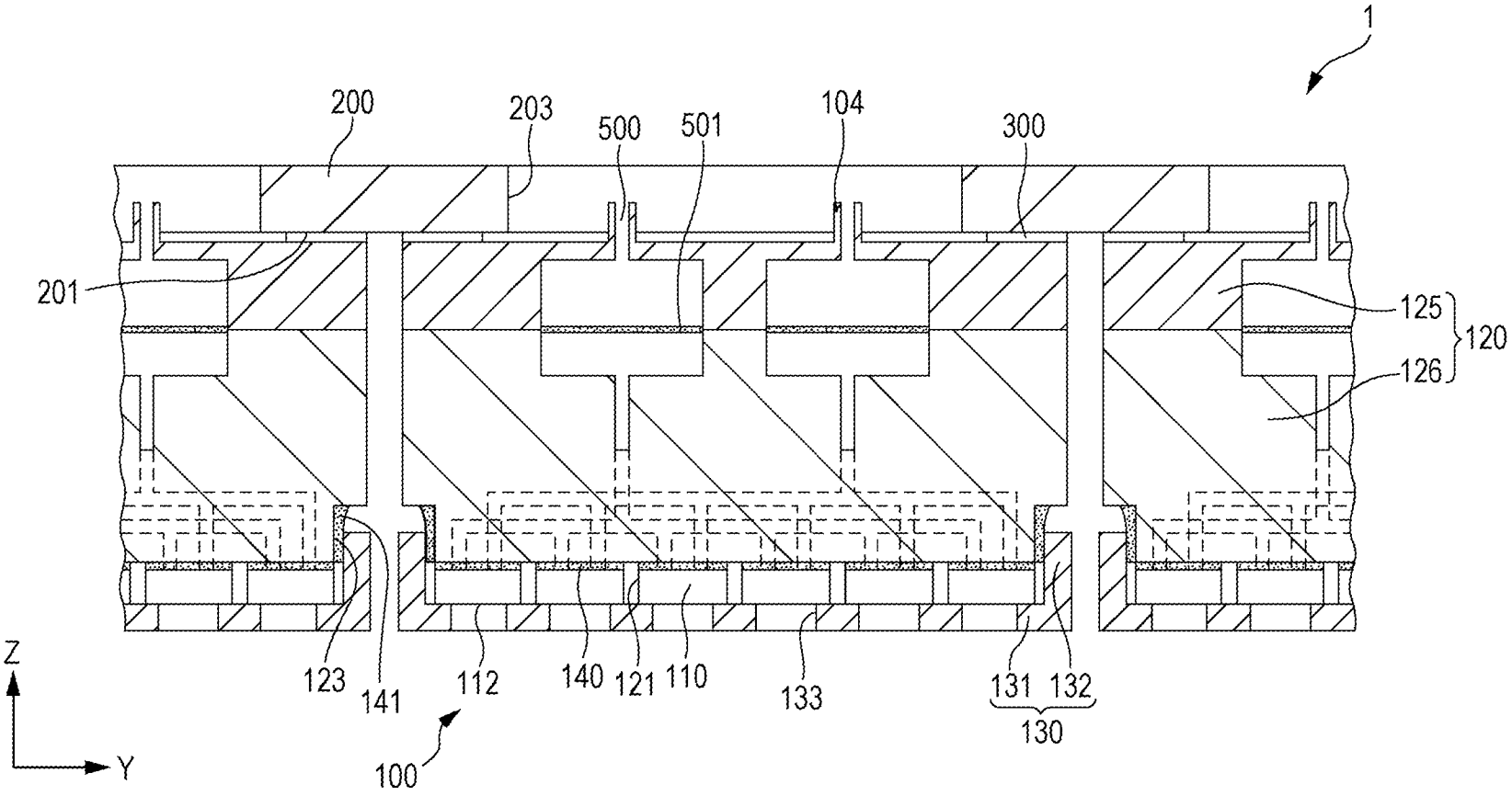
FIG. 6 is a cross-sectional view of the head unit according to Embodiment 1 of the invention.

The base portion 131 is joined to the surface on the Z1 side in the third direction Z of the holder 120, that is, the end surfaces on the Z1 side of the foot portions 122 through an adhesive 141, as shown in FIG. 5A.

Further, an exposure opening portion 133 for opening the nozzle opening 111 of each of the head main bodies 110 is provided in the base portion 131, as shown in FIG. 6. In this embodiment, the exposure opening portion 133 is provided so as to be open independently for each head main body 110. That is, since the ink jet type recording head 100 in this embodiment has the six head main bodies 110, six independent exposure opening portions 133 are provided in the base portion 131. Of course, according to the configuration or the like of the head main body 110, a single common exposure opening portions 133 may be provided with respect to a head main body group which is composed of the plurality of head main bodies 110.

In addition, in this embodiment, since the foot portion 122 is not provided in the second direction Y of the holding portion 121, the exposure opening portion 133 is provided in the vicinity of the bent portion 132 in the second direction Y. That is, the distance from the whole circumference of the base portion 131 to the exposure opening portion 133 is made to be smaller in the second direction Y than the first direction X.

The Z1 side of the holding portion 121 of the holder 120 is covered with the base portion 131.

Further, the bent portions 132 are provided at both end portions in the second direction Y of the base portion 131 and are each formed in a size so as to cover an opening area which is open in the side surface in the second direction Y of the holding portion 121. That is, the bent portion 132 is an area extending from an end portion in the second direction Y of the base portion 131 to an edge portion of the cover 130. Then, the bent portion 132 is bonded to the side surface in the second direction Y of the holder 120 through the adhesive 141. In this way, openings to the side surfaces in the second direction Y of the holding portion 121 are covered and sealed by the bent portions 132.

That is, on both sides in the first direction X of the holder 120 and the cover 130, end surfaces in the third direction Z of the foot portions 122 and the base portion 131 are bonded to each other by the adhesive 141, and on both sides in the second direction Y, the opened side surfaces of the holding portion 121 and the bent portions 132 are bonded to each other by the adhesive 141, whereby the head main bodies 110 are disposed in the holding portion 121 which is a space between the holder 120 and the cover 130. That is, the adhesive 140 bonding the head main body 110 and the holder 120 together is included in the holding portion 121 which is a space formed by bonding the holder 120 and the cover 130 together by the adhesive 141. Therefore, even if the adhesive 140 through which moisture contained in ink easily permeates is used as the adhesive 140 bonding the holder 120 and the head main body 110 together, the holding portion 121 is sealed by the adhesive 141 bonding the holder 120 and the cover 130 together, and therefore, it is possible to prevent the evaporation of moisture contained in ink. In addition, in order to seal the holding portion 121, it is preferable to bond the base portion 131 of the cover 130 and the liquid ejecting surface 112 side of the head main body 110 together. That is, it is preferable that the periphery of the exposure opening portion 133 be bonded to the head main body 110 such that the moisture does not evaporate to the outside through the exposure opening portion 133. Further, it is preferable that the adhesive 141 bonding the holder 120 and the cover 130 together be an adhesive which is more difficult for the moisture to permeate than the adhesive 140 which bonds the holder 120 and the head main body 110 together and absorbs variation in the height of the head main body 110.

In this manner, in this embodiment, on both sides in the second direction Y of the holder 120, the bent portions 132 are provided in the cover 130, whereby the cover 130 and the holder 120 are bonded to each other, and therefore, foot portions for being bonded to the base portion 131 of the cover 130 are not required on both sides in the second direction Y of the holder 120. For this reason, when the ink jet type recording heads 100 are arranged side by side in the second direction Y, since a foot portion is not present between the ink jet type recording heads 100 adjacent to each other, it is possible to narrow the distance between the ink jet type recording heads 100 adjacent to each other in the second direction Y. In this way, it is possible to closely provide the head main bodies 110 of the ink jet type recording heads 100 adjacent to each other in the second direction Y, and it is possible to provide the nozzle openings 111 provided in the respective head main bodies 110 of the ink jet type recording heads 100 adjacent to each other, in close proximity to each other in the second direction Y2.

Incidentally, in order to prevent evaporation of moisture contained in ink without providing the bent portions 132 which are bonded to the holder 120, on both sides in the second direction Y of the cover 130, it is necessary to provide foot portions on both sides in the second direction Y of the holder 120 as well and bond the end surfaces on the Z1 side of the foot portions and the base portion 131 together. That is, it is necessary for the holding portion 121 to be provided so as to be open on only the Z1 side in the third direction Z. If the foot portions are provided on both sides in the second direction Y in this manner, the distance between the holding portions 121 of the ink jet type recording heads 100 adjacent to each other becomes wider, and thus it is not possible to closely provide the head main bodies 110 of the ink jet type recording heads 100 adjacent to each other, and the nozzle openings 111 are disposed distantly in the second direction Y. That is, in order to closely provide the ink jet type recording heads 100 adjacent to each other and closely provide the head main bodies 110 of each of the ink jet type recording heads 100, it is favorable for the foot portions 122 not to be provided on both sides in the second direction Y which is an arrangement direction of the ink jet type recording heads 100. Therefore, in the holding portion 121, openings communicating with a space in which the head main bodies 110 are disposed are provided in both side surfaces in the second direction Y. Further, in such a configuration, if the cover 130 is bonded to only the end surfaces on the Z1 side of the foot portions 122 of the holder 120, the holding portion 121 is open to the outside in both side surfaces in the second direction Y, and thus moisture permeating the adhesive 140 bonding the holder 120 and the head main body 110 together evaporates to the outside.

In this embodiment, the holding portion 121 which is open in both side surfaces in the second direction Y in order to closely provide the head main bodies 110 is sealed by the bent portions 132 of the cover 130, whereby it is possible to narrow the distance between the ink jet type recording heads 100 adjacent to each other in the second direction Y without providing foot portions on both sides in the second direction Y, and thus it is possible to closely provide the nozzle openings 111 of the ink jet type recording heads 100 adjacent to each other and to prevent the evaporation of moisture permeating the adhesive 140 which bonds the head main bodies 110 and the holder 120 together.

In addition, in this embodiment, a configuration is made such that concave portions 123 are provided in the side surfaces in the second direction Y of the holder 120 and the bent portions 132 are bonded to the concave portions 123. In addition, the concave portions 123 are provided to be open in both side surfaces in the second direction Y and be open in a surface on the Z1 side in the third direction Z. The concave portion 123 is provided in the holder 120 in this manner, whereby the bent portion 132 is inserted into and bonded to the concave portion 123, and therefore, it is possible to easily bond the holder 120 and the bent portion 132 of the cover 130 together. That is, the concave portion 123 is provided in the holder 120, whereby the adhesive 141 is filled between the holder 120 and the bent portion 132 of the cover 130 by a capillary force simply by applying the adhesive 141 between the concave portion 123 and the end portion of the bent portion 132 of the cover 130 inserted into the concave portion 123, and therefore, a process of applying the adhesive 141 to a surface in a different direction along the end portion of the bent portion 132 with respect to the gap between the holder 120 and the bent portion 132 without the concave portion 123 is not required, and thus it is possible to simplify a bonding process. Further, in this embodiment, the concave portion 123 is provided in the holder 120, whereby the amount of protrusion in the second direction Y of the bent portion 132 of the cover 130 is reduced, and thus it is possible to further narrow the distance between the ink jet type recording heads 100 adjacent to each other in the second direction Y and it is possible to further narrow the distance between the nozzle openings 111 of the ink jet type recording heads 100 adjacent to each other. Further, the concave portion 123 is provided in the holder 120 and the bent portion 132 is inserted into the concave portion 123, whereby even if variation occurs in the bending angle of the bent portion 132, it is possible to reduce the amount of protrusion in the second direction Y of the bent portion 132, and therefore, it is possible to prevent the bent portion 132 from interfering with the adjacent ink jet type recording head 100. Also due to this, it is possible to narrow the distance between the ink jet type recording heads 100 adjacent to each other.

In this manner, in the head unit 3 according to this embodiment, when the plurality of ink jet type recording heads 100 are provided to be arranged side by side in the second direction Y at the head fixing substrate 200, it is possible to narrow the distance between the ink jet type recording heads 100 adjacent to each other in the second direction Y by the spacer 300, and therefore, it is possible to narrow the distance between the nozzle openings 111 of the ink jet type recording heads 100 adjacent to each other. Further, since it is possible to narrow the distance between the nozzle openings 111 of the ink jet type recording heads 100 adjacent to each other, the plurality of ink jet type recording heads 100 can be arranged side by side on a straight line extending in the second direction Y, and the width in the first direction X of the head unit 3 can be reduced. Incidentally, when it is assumed that the ink jet type recording heads 100 are arranged side by side on a straight line in the second direction Y, in a case where it is not possible to closely provide the ink jet type recording heads 100 in the second direction Y, in order to continuously dispose dots formed by landing ink ejected from the respective nozzle openings 111 of the plurality of ink jet type recording heads 100 on the recording sheet S, at regular intervals in the second direction Y, it is necessary to dispose the respective ink jet type recording heads 100 in a zigzag manner in the second direction Y. Here, disposing the ink jet type recording heads 100 in a zigzag manner in the second direction Y is to dispose the ink jet type recording heads 100 arranged side by side in the second direction Y, so as to be alternately shifted in the first direction X, and two rows of the ink jet type recording heads 100 arranged side by side in the second direction Y are arranged side by side in the first direction X. In a case of disposing the ink jet type recording heads 100 in a zigzag manner in this manner, the width in the first direction X of the head unit 3 becomes larger. Further, if the width in the first direction X of the head unit 3 becomes larger, the distance in the first direction X between the first transport roller 5 and the second transport roller 6 in the ink jet type recording apparatus 1 shown in FIG. 1 becomes more distant, and thus the fixing of the posture of the recording sheet S becomes difficult, or the sizes of the head unit 3 and the ink jet type recording apparatus 1 increases.

In this embodiment, since it is possible to reduce the width in the first direction X of the head unit 3, it is possible to reduce the distance in the first direction X between the first transport roller 5 and the second transport roller 6, and thus the fixing of the posture of the recording sheet S becomes easy, whereby it is possible to improve printing quality. Further, it becomes possible to reduce the sizes of the head unit 3 and the ink jet type recording apparatus 1.

Embodiment 2

Figure 7:
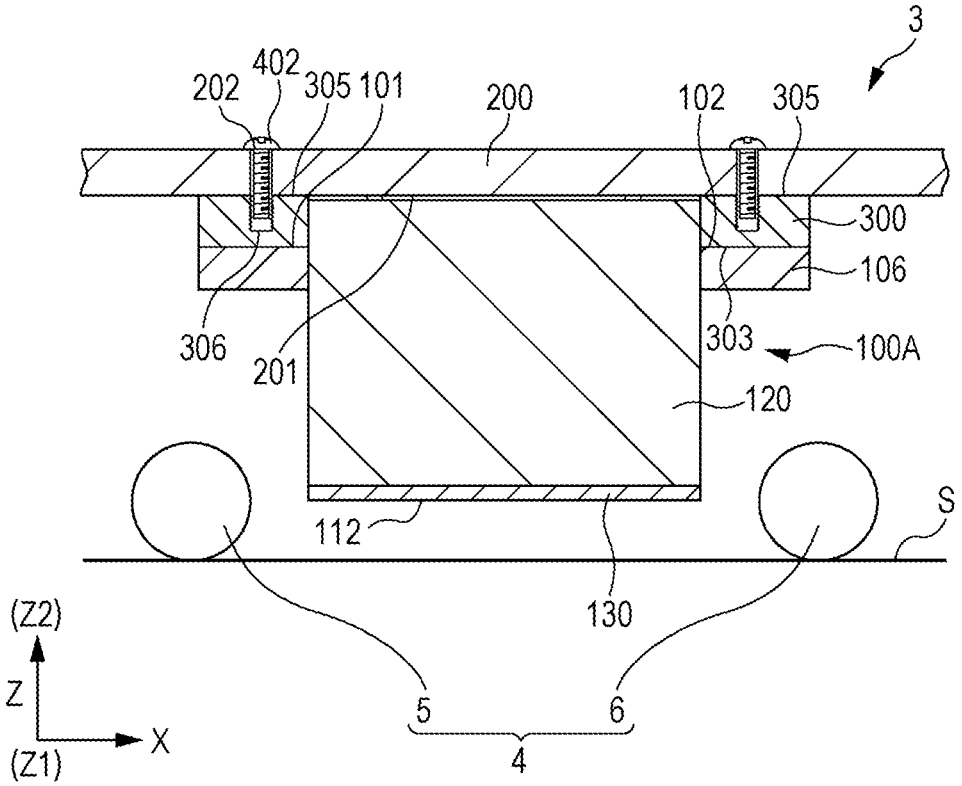
FIG. 7 is a cross-sectional view of a main section of a head unit according to Embodiment 2 of the invention.

FIG. 7 is a cross-sectional view of a main section of an ink jet type recording head unit which is an example of a liquid ejecting head unit according to Embodiment 2 of the invention. In addition, the same member as that in Embodiment 1 described above is denoted by the same reference numeral and overlapping description is omitted.

As shown in FIG. 7, the head unit 3 according to this embodiment is provided with an ink jet type recording head 100A, the head fixing substrate 200, and the spacer 300.

In the ink jet type recording head 100A, a flange portion 106 provided to protrude further in the second direction Y than the liquid ejecting surface 112 side is provided on the Z2 side which is the side opposite to the liquid ejecting surface 112 in the third direction Z.

The flange portion 106 is disposed at a height which does not interfere with the first transport roller 5 and the second transport roller 6 provided on both sides in the first direction X of the head unit 3, in the third direction Z. Further, the first concave portion 101 is provided on the Z2 side of the flange portion 106.

Then, the spacer 300 is disposed such that a portion of the spacer 300 is located further to the outside than the outline on the liquid ejecting surface 112 side of the ink jet type recording head 100A in the first direction X which is the transport direction of the recording sheet S. Further, the spacer 300 in this embodiment is detachably fixed to the flange portion 106 by the first screw member 401 (not shown). In this embodiment, a configuration is made such that the entirety of the spacer 300 is disposed further to the outside than the outline on the liquid ejecting surface 112 side of the ink jet type recording head 100A in the first direction X.

In this manner, at least a portion of the spacer 300 is disposed further to the outside than the outline on the liquid ejecting surface 112 side of the ink jet type recording head 100A in the first direction X, whereby the two spacers 300 can be disposed with a wide distance therebetween in the first direction X. Therefore, when adjusting the inclination angle of the liquid ejecting surface 112 by the spacers 300 having different heights in the first direction X, compared to a case where both the spacers 300 are on the inside of the outline on the liquid ejecting surface 112 side of the ink jet type recording head 100A in the first direction X, it is possible to perform the adjustment of the inclination angle of the liquid ejecting surface 112 with a high degree of accuracy. That is, the outline on the liquid ejecting surface 112 side of the ink jet type recording head 100A is an outline at a position which interferes with the first transport roller 5 and the second transport roller 6, similar to Embodiment 1 described above.

Further, in this embodiment, although the size of the head unit 3 increases in the first direction X by an amount corresponding to the flange portion 106 which is provided, since the flange portion 106 increased in size or the spacer 300 is provided at a position which does not interfere with the first transport roller 5 and the second transport roller 6, the distance in the first direction X between the first transport roller 5 and the second transport roller 6 does not become wider, and thus it is possible to prevent the fixing of the posture of the recording sheet S from becoming difficult.

In addition, the spacer 300 in this embodiment is detachably fixed to the flange portion 106 by the first screw member 401 (not shown). However, the spacer 300 may be detachably fixed to the flange portion 106 by the second screw member 402.

Embodiment 3

Figure 8:
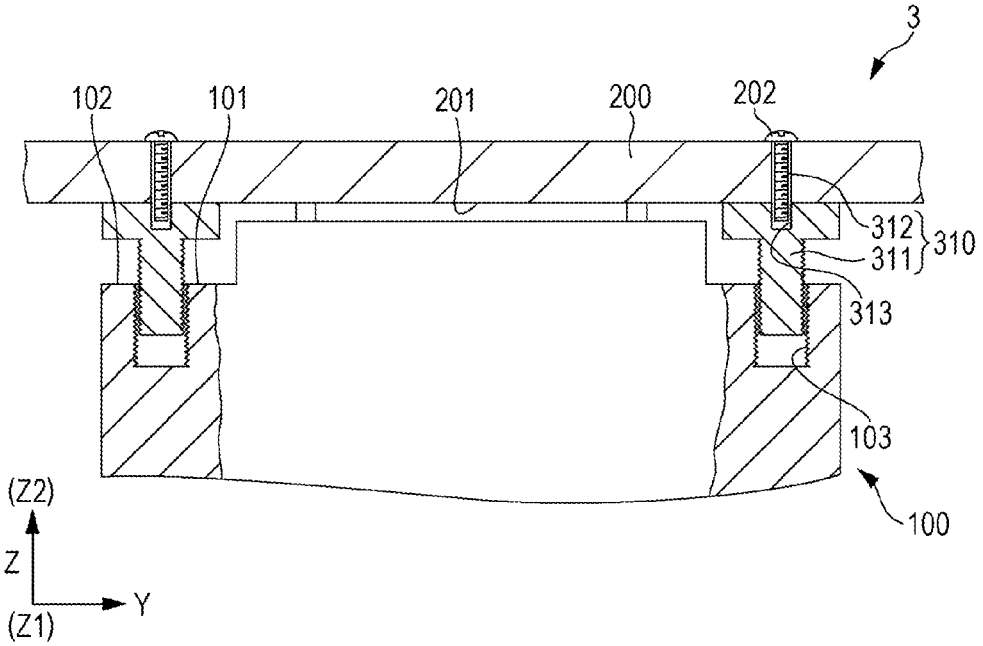
FIG. 8 is a cross-sectional view of a main section of a head unit according to Embodiment 3 of the invention.

FIG. 8 is a cross-sectional view of a main section of an ink jet type recording head unit which is an example of a liquid ejecting head unit according to Embodiment 3 of the invention. In addition, the same member as those in the embodiments described above is denoted by the same reference numeral and overlapping description is omitted.

As shown in FIG. 8, the head unit 3 is provided with the plurality of ink jet type recording heads 100, the head fixing substrate 200, and a fastening member 310 which is the height changing-fixing section.

The ink jet type recording head 100 is detachably fixed to the head fixing substrate 200 through the fastening member 310.

Here, the fastening member 310 has a fourth screw member 311 which is screwed to the ink jet type recording head 100, and a fifth screw member 312 which is screwed to the surface on the Z2 side of the fourth screw member 311.

Then, the fourth screw member 311 is screwed into the first fixing hole 103 provided in the surface on the Z2 side of the ink jet type recording head 100, whereby the fastening member 310 is detachably fixed to the ink jet type recording head 100. That is, the fastening member 310 is detachably fixed by screwing from the surface side opposite to the ink jet type recording head 100, of the fastening member 310.

Further, a fourth fixing hole 313 which is open in a surface on the Z2 side is provided in the fourth screw member 311 of the fastening member 310. Then, the fifth screw member 312 is inserted from the surface side opposite to the fixing surface 201 of the head fixing substrate 200 and screwed into the fourth fixing hole 313 of the fourth screw member 311, whereby the fourth screw member 311 is detachably fixed to the fixing surface 201 of the head fixing substrate 200. That is, the fastening member 310 is detachably fixed by screwing from the Z2 side of the head fixing substrate 200 by the fourth screw member 311.

In this manner, the fastening member 310 is detachably fixed to the ink jet type recording head 100 and then detachably fixed to the head fixing substrate 200, whereby the ink jet type recording head 100 can be easily mounted on and dismounted from the head fixing substrate 200.

Further, in this embodiment, the adjustment of the height of the liquid ejecting surface 112 of the ink jet type recording head 100 or the adjustment of the inclination of the liquid ejecting surface 112 can be performed by adjusting the amount of screwing of the fourth screw member 311 into the ink jet type recording head 100. That is, it is not necessary to prepare the plurality of spacers 300 having different thicknesses, as in Embodiment 1 described above, and it is possible to adjust the height and the inclination of the liquid ejecting surface 112 of the ink jet type recording head 100 simply by providing at least three fastening members 310 in one ink jet type recording head 100, and thus it becomes possible to reduce the cost.

Other Embodiments

The embodiments of the invention have been described above. However, the basic configuration of the invention is not limited to the embodiments described above.

For example, in each of the embodiments described above, the spacer 300 is provided so as not to protrude from the outline in the second direction Y of the ink jet type recording head 100 or 100A. However, it is not particularly limited thereto and at least a portion of the spacer 300 may be provided to protrude from the outline in the second direction Y of the ink jet type recording head 100 or 100A.

Further, at least three of the height changing-fixing section such as the spacer 300 or the fastening member 310 are provided with respect to one ink jet type recording head 100 or 100A, whereby it is possible to adjust the inclination in both the first direction X and the second direction Y of the liquid ejecting surface 112. However, of course, it is not limited thereto, and two spacers 300, fastening members 310, or the like may be provided with respect to one ink jet type recording head 100 or 100A. In this way, the adjustment of the inclination in only either one of the first direction X and the second direction Y of the liquid ejecting surface 112 becomes possible. Of course, one spacer 300 or the like may also be provided with respect to one ink jet type recording head 100 or 100A.

In addition, in each of the embodiments described above, the height changing-fixing section such as the spacer 300 or the fastening member 310 is screwed by the second screw member 402, the fifth screw member 312, or the like from the Z2 side in the third direction Z which is the surface side opposite to the ink jet type recording head 100 or 100A. However, it is not particularly limited thereto, and for example, the spacer 300, the fastening member 310, or the like may be disposed in the first direction X or the second direction Y with respect to the ink jet type recording head 100 or 100A and detachably fixed by screwing from the surface side opposite to the ink jet type recording head 100 or 100A, of the spacer 300, the fastening member 310, or the like, that is, the first direction X or the second direction Y. Further, the spacer 300 or the fastening member 310 may also be unable to be detached from the ink jet type recording head 100 or 100A. That is, even if the spacer 300 or the fastening member 310 is fixed to the ink jet type recording head 100 or 100A by adhesion or the like so as to be unable to be easily detached, the ink jet type recording head 100 or 100A can be mounted on and detached from the head fixing substrate 200.

Further, in each of the embodiments described above, a configuration is illustrated in which the ink jet type recording head 100 or 100A or the like is provided with the head main body 110, the holder 120, and the cover 130. However, it is not particularly limited thereto, and the ink jet type recording head 100 or 100A may be provided with other members. Further, a configuration is made such that the filter 501 is provided in the holder 120. However, of course, the filter 501 may not be provided. In a case where the filter 501 is not provided in the ink jet type recording head 100 or 100A, it is acceptable if a filter is provided in the middle between the liquid storage means and the ink jet type recording head 100 or 100A. Similarly, the first member 125 and the second member 126 configuring the holder 120 may be fixed to each other by adhesion or the like in a state of being unable to be easily detached from each other. Of course, the first member 125 and the second member 126 may also be fixed to each other by screwing from the side opposite to the first member 125, of the second member 126.

Further, in Embodiment 1 described above, the arrangement direction of the plurality of ink jet type recording heads 100 held by the head fixing substrate 200 is set to be the second direction Y which is a direction perpendicular to the first direction X which is the transport direction of the recording sheet S. However, it is not particularly limited thereto, and the head unit in which the ink jet type recording heads 100 are arranged side by side in a longitudinal direction of the head fixing substrate 200 may be disposed such that the arrangement direction of the plurality of ink jet type recording heads 100 forms an intersecting angle with respect to the first direction X which is the transport direction of the recording sheet S, that is, an angle smaller than 90 degrees with respect to the first direction X. In this case, even if a nozzle row is provided in a direction perpendicular to the longitudinal direction of the head fixing substrate 200 in the in-plane direction of the liquid ejecting surface 112, by inclining the entire head unit, it is possible to dispose a nozzle row inclined with respect to the first direction X which is the transport direction.

Figure 9:
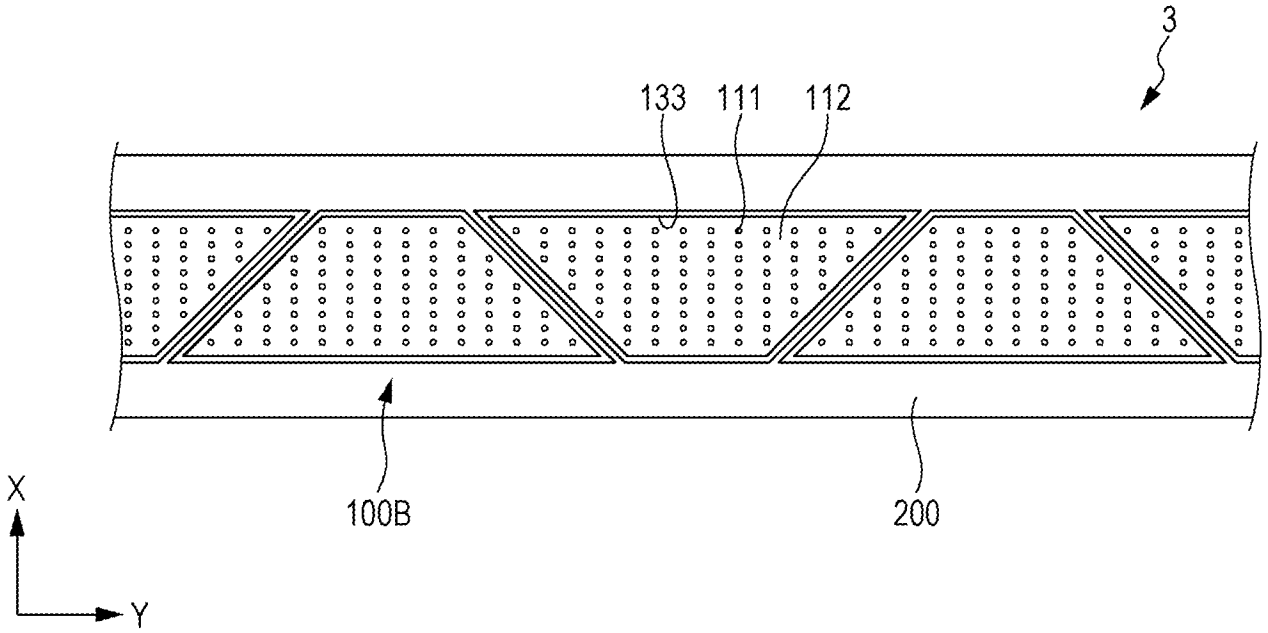
FIG. 9 is a plan view of a head unit according to another embodiment of the invention.

In addition, in each of the embodiments described above, the fourth direction Xa which is the arrangement direction of the nozzle openings 111 of the head main body 110 is disposed so as to become a direction inclined with respect to the second direction Y orthogonal to the first direction X which is the transport direction. However, the fourth direction Xa which is the arrangement direction of the nozzle openings 111 may be set so as to be the same direction as the first direction X which is the transport direction, and the fourth direction Xa which is the arrangement direction of the nozzle openings 111 may also be set so as to be the same direction as the second direction Y. In addition, the nozzle openings 111 are not limited to being provided in a row shape, and the nozzle openings 111 may be disposed in a matrix form. In addition, in Embodiment 1 described above, the holder 120 is made so as to have an approximately parallelogram shape when viewed in plan view from the third direction Z perpendicular to the liquid ejecting surface 112. However, it is not particularly limited thereto, and a rectangular shape, a trapezoidal shape, a polygonal shape, or the like is also acceptable. Here, one such example is shown in FIG. 9. In addition, FIG. 9 is a plan view from the liquid ejecting surface side of an ink jet type recording head unit which is an example of a liquid ejecting head unit according to another embodiment of the invention.

As shown in FIG. 9, an ink jet type recording head 100B has a trapezoidal shape when viewed in plan view from the liquid ejecting surface 112 side. Further, a plurality of ink jet type recording heads 100B are arranged side by side in the second direction Y and fixed to the head fixing substrate 200, and the ink jet type recording heads 100B arranged side by side in the second direction Y are alternately disposed to be rotated by 180 degrees in the in-plane direction of the liquid ejecting surface 112.

In the ink jet type recording head 100B, the nozzle openings 111 are disposed in a matrix form in the liquid ejecting surface 112. Even in such a configuration, similar to each of the embodiments described above, the ink jet type recording head 100B is detachably provided on the head fixing substrate 200 by using the spacer 300, the fastening member 310, or the like which is the height changing-fixing section, whereby it is possible to exhibit the same effects as those in the embodiments described above.

In addition, also in the ink jet type recording heads 100 and 100A of the respective embodiments described above, the nozzle openings 111 may be disposed in a matrix form.

Further, in the examples described above, the ink jet type recording heads 100, 100A, or 100B are provided in a state where the outline which becomes the boundary between the ink jet type recording heads 100, 100A, or 100B adjacent to each other in the second direction Y when viewed from the third direction Z orthogonal to the liquid ejecting surface 112 is inclined with respect to the first direction X which is the transport direction of the recording sheet S. However, of course, it is not limited thereto, and the boundary between the ink jet type recording heads adjacent to each other in the second direction Y may be provided along the transport direction of the recording sheet S.

In addition, in Embodiment 1 described above, as the ink jet type recording apparatus 1, a so-called line type recording apparatus which performs printing simply by transporting the recording sheet S with the head unit 3 fixed to the apparatus main body 2 is illustrated. However, it is not particularly limited thereto, and the invention can also be applied to a so-called serial type recording apparatus in which the head unit 3 is mounted on a carriage which moves in a direction crossing the first direction X which is the transport direction of the recording sheet S, for example, the second direction Y, and printing is performed while moving the head unit 3 in the direction crossing the transport direction. Further, it is not limited to a configuration of transporting the recording sheet S with respect to the head unit 3, and printing may be performed by a configuration of moving the head unit 3 with respect to the recording sheet S, and it is acceptable if the recording sheet S is transported relative to the head unit 3.

In addition, in the embodiments described above, the ink jet type recording head unit has been described by being given as an example of the liquid ejecting head unit, and the ink jet type recording apparatus has been described by being taken as an example of the liquid ejecting apparatus. However, the invention is broadly a liquid ejecting head unit and a liquid ejecting apparatus in general and can also be, of course, applied to a liquid ejecting head unit or a liquid ejecting apparatus which ejects liquid other than ink. As other liquid ejecting heads, various recording heads which are used in an image recording apparatus such as a printer, a color material ejecting head which is used in the manufacturing of a color filter of a liquid crystal display or the like, an electrode material ejecting head which is used in the formation of an electrode of an organic EL display, a field emission display (FED), or the like, a bioorganic material ejecting head which is used in the manufacturing of a bio chip, or the like can be given as an example, and the invention can also be applied to liquid ejecting head units and liquid ejecting apparatuses provided with such liquid ejecting heads.

What is claimed is:

1. A liquid ejecting head unit comprising:

a liquid ejecting head having a liquid ejecting surface in which a nozzle opening for ejecting liquid is formed;

a head fixing substrate which holds the surface sides opposite to the liquid ejecting surfaces of a plurality of liquid ejecting heads; and a height changing-fixing section which is provided between the head fixing substrate and the liquid ejecting head and can adjust a distance between the head fixing substrate and the liquid ejecting head, wherein the height changing-fixing section is detachably fixed to the surface opposite to the liquid ejecting surface of the liquid ejecting head, and the height changing-fixing section and the head fixing substrate are detachably fixed to each other by screwing from the surface side opposite to a fixing surface of the head fixing substrate, to which the liquid ejecting head is fixed through the height changing-fixing section.

2. The liquid ejecting head unit according to claim 1, wherein the plurality of liquid ejecting heads are arranged side by side on the head fixing substrate, and when viewed from a direction orthogonal to the liquid ejecting surface, an outline which becomes a boundary on the liquid ejecting surface side between the liquid ejecting heads adjacent to each other in an arrangement direction of the liquid ejecting heads is provided to be inclined with respect to a relative movement direction of a recording medium.

3. The liquid ejecting head unit according to claim 1, wherein the plurality of liquid ejecting heads are arranged side by side on the head fixing substrate, and when viewed from a direction orthogonal to the liquid ejecting surface, the height changing-fixing section for each liquid ejecting head is disposed at a position which falls within an outline of the liquid ejecting head in an arrangement direction of the liquid ejecting heads.

4. The liquid ejecting head unit according to claim 1, wherein a plurality of the liquid ejecting heads are arranged side by side on the head fixing substrate, and when viewed from a direction orthogonal to the liquid ejecting surface, at least a portion of the height changing-fixing section for each liquid ejecting head is provided further to the outside than an outline on the liquid ejecting surface side of the liquid ejecting head in a relative movement direction of a recording medium.

5. The liquid ejecting head unit according to claim 1, wherein at least three of the height changing-fixing sections are provided for each liquid ejecting head.

6. The liquid ejecting head unit according to claim 1, wherein a contact surface between the height changing-fixing section and the liquid ejecting head is located further to the liquid ejecting surface side than an end portion on the head fixing substrate side of the liquid ejecting head in a direction orthogonal to the liquid ejecting surface.

7. The liquid ejecting head unit according to claim 1, wherein the height changing-fixing section and the liquid ejecting head are detachably fixed to each other by screwing from the surface side opposite to the liquid ejecting head, of the height changing-fixing section.

8. The liquid ejecting head unit according to claim 1, wherein the liquid ejecting head is provided with first and second members with flow paths provided therein, the height changing-fixing section is fixed to the first member, the first member and the second member are detachably fixed to each other, and a filter crossing the flow path is provided in the first member.

9. The liquid ejecting head unit according to claim 8, wherein the first member and the second member are fastened to each other by screwing from the surface side opposite to the second member, of the first member.

10. A liquid ejecting apparatus comprising: the liquid ejecting head unit according to claim 1.

11. A liquid ejecting apparatus comprising: the liquid ejecting head unit according to claim 2.

12. A liquid ejecting apparatus comprising: the liquid ejecting head unit according to claim 3.

13. A liquid ejecting apparatus comprising: the liquid ejecting head unit according to claim 4.

14. A liquid ejecting apparatus comprising: the liquid ejecting head unit according to claim 5.

15. A liquid ejecting apparatus comprising: the liquid ejecting head unit according to claim 6.

16. A liquid ejecting apparatus comprising: the liquid ejecting head unit according to claim 7.

17. A liquid ejecting apparatus comprising: the liquid ejecting head unit according to claim 8.

18. A liquid ejecting apparatus comprising: the liquid ejecting head unit according to claim 9.

* * * * *